US011624269B2

(12) United States Patent
Sheth et al.

(10) Patent No.: US 11,624,269 B2
(45) Date of Patent: Apr. 11, 2023

(54) INTEGRATED GAS SEPARATOR AND PUMP

(71) Applicant: Halliburton Energy Services, Inc., Houston, TX (US)

(72) Inventors: Ketankumar Kantilal Sheth, Tulsa, OK (US); Donn Jason Brown, Tulsa, OK (US); Casey Laine Newport, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 17/369,511

(22) Filed: Jul. 7, 2021

(65) Prior Publication Data

US 2023/0010704 A1 Jan. 12, 2023

(51) Int. Cl.
*E21B 43/12* (2006.01)
*E21B 43/38* (2006.01)

(52) U.S. Cl.
CPC ..... *E21B 43/128* (2013.01); *E21B 43/38* (2013.01)

(58) Field of Classification Search
CPC ..... E21B 43/13; E21B 43/34; E21B 43/38; E21B 43/126; E21B 43/128
See application file for complete search history.

(56) References Cited

U.S. PATENT DOCUMENTS 4,187,912 A 2/1980 Cramer
4,481,020 A 11/1984 Lee et al.
4,913,630 A 4/1990 Cotherman et al.
5,431,228 A * 7/1995 Weingarten ..... B01D 19/0057 166/69
5,525,146 A 6/1996 Straub
(Continued)

FOREIGN PATENT DOCUMENTS

CN 106076006 A 11/2016
CN 205965282 U 2/2017
(Continued)

OTHER PUBLICATIONS

Filing Receipt, Specification and Drawings for U.S. Non-Provisional U.S. Appl. No. 17/492,227, filed Oct. 31, 2021, titled "Charge Pump for Electric Submersible Pump (ESP) Assembly With Inverted Shroud," 66 pages.
(Continued)

*Primary Examiner* — David Carroll
(74) *Attorney, Agent, or Firm* — Conley Rose, P.C.; Rodney B. Carroll

(57) ABSTRACT

A downhole gas separator and pump assembly. The downhole gas separator and pump assembly comprises a drive shaft; a first fluid mover having an inlet and an outlet; a separation chamber located downstream of the first fluid mover and fluidically coupled to the outlet of the first fluid mover; a gas flow path and liquid flow path separator located downstream of the separation chamber, having an inlet fluidically coupled to the separation chamber, having a gas phase discharge port open to an exterior of the assembly, and having a liquid phase discharge port; and a second fluid mover mechanically coupled to the drive shaft, located downstream of the first gas flow path and liquid flow path separator, and having an inlet fluidically coupled to the fluid phase discharge port of the first gas flow path and liquid flow path separator.

20 Claims, 12 Drawing Sheets

(56) References Cited

U.S. PATENT DOCUMENTS

| | | | | |
|---|---|---|---|---|
| 6,066,193 | A | 5/2000 | Lee | |
| 6,113,675 | A * | 9/2000 | Branstetter | B01D 19/0052 96/196 |
| 6,155,345 | A | 12/2000 | Lee et al. | |
| 6,382,317 | B1 | 5/2002 | Cobb | |
| 6,705,402 | B2 | 3/2004 | Proctor | |
| 7,461,692 | B1 | 12/2008 | Wang | |
| 7,462,225 | B1 | 12/2008 | Ketter et al. | |
| 9,283,497 | B2 | 3/2016 | Wang et al. | |
| 10,378,322 | B2 | 8/2019 | Ejim et al. | |
| 10,408,035 | B2 | 9/2019 | Kennedy et al. | |
| 11,149,535 | B2 | 10/2021 | Brown et al. | |
| 2002/0153141 | A1* | 10/2002 | Hartman | E21B 43/128 166/66.4 |
| 2002/0174982 | A1* | 11/2002 | Weingarten | E21B 43/38 166/69 |
| 2003/0111230 | A1 | 6/2003 | Olson et al. | |
| 2010/0147514 | A1 | 6/2010 | Swaringin | |
| 2012/0012332 | A1 | 1/2012 | Rooks | |
| 2013/0068455 | A1* | 3/2013 | Brown | E21B 43/121 166/66.4 |
| 2016/0130923 | A1 | 5/2016 | Nowitzki et al. | |
| 2016/0201444 | A1* | 7/2016 | Hardee | E21B 43/128 166/265 |
| 2017/0081952 | A1 | 3/2017 | Osborne et al. | |
| 2020/0362649 | A1* | 11/2020 | Brown | B01D 19/0057 |

FOREIGN PATENT DOCUMENTS

| | | | |
|---|---|---|---|
| WO | 2017053624 | A1 | 3/2017 |
| WO | 2020072078 | A1 | 4/2020 |

OTHER PUBLICATIONS

Filing Receipt, Specification and Drawings for U.S. Appl. No. 17/492,230, filed Oct. 1, 2021, titled "Charge Pump for Electric Submersible Pump (ESP) Assembly," 59 pages.

Foreign Communication from Related Application—International Search Report and Written Opinion of the International Searching Authority, International Application No. PCT/US2020/022038, dated Nov. 27, 2020, 13 pages.

Foreign Communication from Related Application—International Search Report and Written Opinion of the Internationa Searching Authority, International Application No. PCT/US2021/042395, dated Mar. 25, 2022, 14 pages.

Foreign Communication from Related Application—International Search Report and Written Opinion of the International Searching Authority, International Application No. PCT/US2021/042389, dated Apr. 4, 2022, 11 pages.

Filing Receipt, Specification and Drawings for U.S. Appl. No. 17/369,526, entitled "Electric Submersible Pump (ESP) Gas Slug Processor and Mitigation System," filed Jul. 7, 2021, 70 pages.

Electronic Acknowledgment Receipt, Specification and Drawings for International Application No. PCT/US2021/042389, entitled "Integrated Gas Separator and Pump," filed Jul. 20, 2021, 50 pages.

Electronic Acknowledgment Receipt, Specification and Drawings for International Application No. PCT/JS2021/042395, entitled "Electric Submersible Pump (ESP) Gas Slug Processor and Mitigation System," filed Jul. 20, 2021, 51 pages.

Office Action dated Jan. 3, 2023 (50 pages), U.S. Appl. No. 17/369,526, filed Jul. 7, 2021.

* cited by examiner

INTEGRATED GAS SEPARATOR AND PUMP

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, performing the necessary steps to produce the hydrocarbons from the subterranean formation, and pumping the hydrocarbons to the surface of the earth.

When performing subterranean operations, pump systems, for example, electric submersible pump (ESP) systems, may be used when reservoir pressure alone is insufficient to produce hydrocarbons from a well or is insufficient to produce the hydrocarbons at a desirable rate from the welt Presence of gas or free gas in a reservoir or fluid of a wellbore and the resulting multiphase flow behavior of the fluid has a detrimental effect on pump performance and pump system cooling. Economic and efficient pump operations may be affected by gas laden fluid. The presence of gas in a pump causes a drop in pressure created within the pump stages, reducing output of the pump. High concentrations of gas within a pump can create a condition commonly referred to as "gas lock", where gas is so prominent within the stages of the pump, the intended production liquid no longer reaches the surface. Separation of gas from the liquid phase of the fluid before entry into the pump improves pump performance, decreases pump vibration and reduces the operating temperature of the pump. An effective, efficient and reliable pump gas separation system is needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
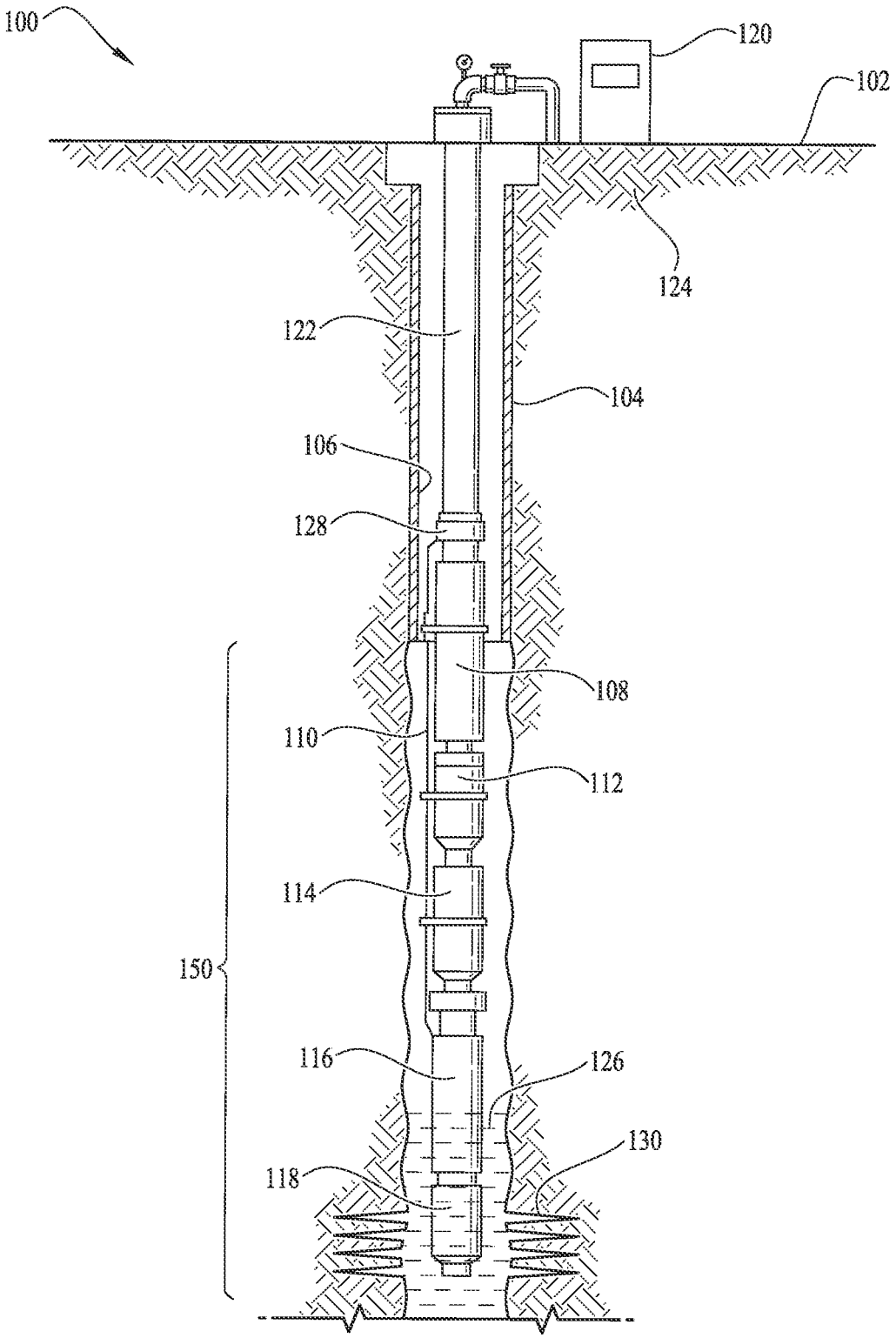
FIG. 1 is an illustration of an electric submersible pump assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageways) of the second component.

Gas entering an electric submersible pump (ESP) can cause various difficulties for a centrifugal pump. In an extreme case, the ESP may become gas locked and become unable to pump fluid. In less extreme cases, the ESP may experience harmful operating conditions when transiently passing a slug of gas. When in operation, the ESP rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the ESP may heat up rapidly and undergo significant wear, shortening the operational life of the ESP, thereby increasing operating costs due to more frequent change-out and/or repair of the ESP. In some operating environments, for example in some horizontal wellbores, gas slugs that persist for at least 10 seconds are repeatedly experienced. Some gas slugs may persist for as much as 30 seconds or more.

To mitigate these effects of gas in an ESP, a gas separator can be placed upstream of a centrifugal pump assembly to separate gas phase fluid from the liquid phase fluid, discharge the gas phase fluid into the wellbore outside of the gas separator, and discharge the liquid phase fluid to an inlet of the centrifugal pump assembly. But in a high flow production regime, the coupling between the fluid phase outlet of the gas separator to the inlet of the centrifugal pump assembly can undesirably throttle and limit the rate of production of hydrocarbons by the ESP, for example due to a narrowed flow path through a neck formed at a coupling between the gas separator and the centrifugal pump assembly. For example, a shoulder may be introduced into the top of the gas separator to provide bolt holes and a neck narrowing may be introduced into the bottom of the centrifugal pump assembly to allow space for tools to screw in bolts to secure the bottom of the centrifugal pump assembly to the top of the gas separator.

Additionally, a spline coupling at the joint between a drive shaft in the gas separator and a drive shaft in the centrifugal pump assembly may further restrict the flow path for liquid phase fluid from the liquid phase discharge of the gas separator to the inlet of the centrifugal pump assembly. The spline coupling may comprise external teeth or grooves on a drive shaft of the gas separator, external teeth or grooves on a drive shaft of the centrifugal pump assembly, and a hub, a spline coupler, or a coupling sleeve having internal teeth that mate with the external teeth or grooves of the two shafts. The outside diameter of the hub or spline coupling protrudes into the flow path (e.g., is greater in diameter than the diameter of either drive shaft). This flow path restriction can reduce or limit the flow of fluid through the centrifugal pump assembly and hence the rate of production of hydrocarbons to the surface.

The present disclosure teaches an integrated gas separator and pump assembly that overcomes this limitation by providing a centrifugal pump stage (or a plurality of centrifugal pump stages) having an inlet downstream of the liquid phase discharge of the crossover (e.g., a gas flow path and liquid flow path separator) and an outlet upstream of the inlet of the centrifugal pump assembly. In this case, the pump in the integrated gas separator and pump assembly can maintain a higher rate of flow across the narrowed throat at the coupling of the integrated gas separator and pump assembly with the centrifugal pump assembly because it is forcing the liquid phase fluid across this narrow throat.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming, but would nevertheless be a routine undertaking for those of ordinary skill in the art having the benefit of the present disclosure.

FIG. 1 illustrates a well site environment 100, according to one or more aspects of the present invention. While well site environment 100 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

In one or more embodiments, well site environment 100 comprises a wellbore 104 below a surface 102 in a formation 124. In one or more embodiments, a wellbore 104 may comprise a nonconventional, horizontal or any other type of wellbore. Wellbore 104 may be defined in part by a casing string 106 that may extend from a surface 102 to a selected downhole location. Portions of wellbore 104 that do not comprise the casing string 106 may be referred to as open hole.

In one or more embodiments, various types of hydrocarbons or fluids may be pumped from wellbore 104 to the surface 102 using an electric submersible pump (ESP) assembly 150 disposed or positioned downhole, for example, within, partially within, or outside casing 106 of wellbore 104. ESP assembly 150 may comprise a centrifugal pump assembly 108, an electric cable 110, an integrated gas separator and pump assembly 112, a seal or equalizer 114, an electric motor 116, and a sensor package 118. In an embodiment, the centrifugal pump assembly 108 may comprise one or more centrifugal pump stages, each centrifugal pump stage comprising an impeller mechanically coupled to a drive shaft of the centrifugal pump assembly and a corresponding diffuser held stationary by and retained within the centrifugal pump assembly (e.g., retained by a housing of the centrifugal pump assembly). In an embodiment, the centrifugal pump assembly 108 may not contain a centrifugal pump but instead may comprise a rod pump, a progressive cavity pump, or any other suitable pump system or combination thereof.

The centrifugal pump assembly 108 may transfer pressure to the fluid 126 or any other type of downhole fluid to pump or lift the fluid from downhole to the surface 102 at a desired or selected pumping rate. Centrifugal pump assembly 108 couples to the integrated gas separator and pump assembly 112. Integrated gas separator and pump assembly 112 couples to the seal or equalizer 114 which couples to the electric motor 116. The electric motor 116 may be coupled to a downhole sensor package 118. In one or more embodiments, an electric cable 110 is coupled to the electric motor 116 and to a controller 120 at the surface 102. The electric cable 110 may provide power to the electric motor 116, transmit one or more control or operation instructions from controller 120 to the electric motor 116, or both.

In one or more embodiments, fluid 126 may be a multiphase wellbore fluid comprising one or more hydrocarbons. For example, fluid 126 may comprise a gas phase and a liquid phase from a wellbore or reservoir in a formation 124. In one or more embodiments, fluid 126 may enter the wellbore 104, casing 106 or both through one or more perforations 130 in the formation 124 and flow uphole to one or more intake ports of the ESP assembly 150. The centrifugal pump assembly 108 may transfer pressure to the fluid 126 by adding kinetic energy to the fluid 126 via centrifugal force and converting the kinetic energy to potential energy in the form of pressure. In one or more embodiments, centrifugal pump assembly 108 lifts fluid 126 to the surface 102. In some contexts, the fluid 126 may be referred to as reservoir fluid.

Fluid pressure in the wellbore 104 causes fluid 126 to enter the integrated gas separator and pump assembly 112. Integrated gas separator and pump assembly 112 separates a gas phase or component from the liquid phase of fluid 126 before the gas phase enters centrifugal pump assembly 108. In one or more embodiments, electric motor 116 is an electric submersible motor configured or operated to turn one or more components in the integrated gas separator and pump assembly 114 and one or more pump stages of the centrifugal pump assembly 108. In an embodiment, the electric motor 116 may be a two pole, three phase squirrel cage induction motor or any other electric motor operable or configurable to provide rotational power.

Seal or equalizer 114 may be a motor protector that serves to equalize pressure and keep motor oil separate from fluid 126. In one or more embodiments, a production tubing section 122 may couple to the centrifugal pump assembly 108 using one or more connectors 128 or may couple directly to the centrifugal pump assembly 108. In one or more embodiments, any one or more production tubing sections 122 may be mechanically coupled together to extend the ESP assembly 150 into the wellbore 104 to a desired or specified location. Any one or more components of fluid 126 may be pumped from centrifugal pump assembly 108 through production tubing 122 to the surface 102 for transfer to a storage tank, a pipeline, transportation vehicle, any other storage, distribution or transportation system and any combination thereof.

Figure 2:
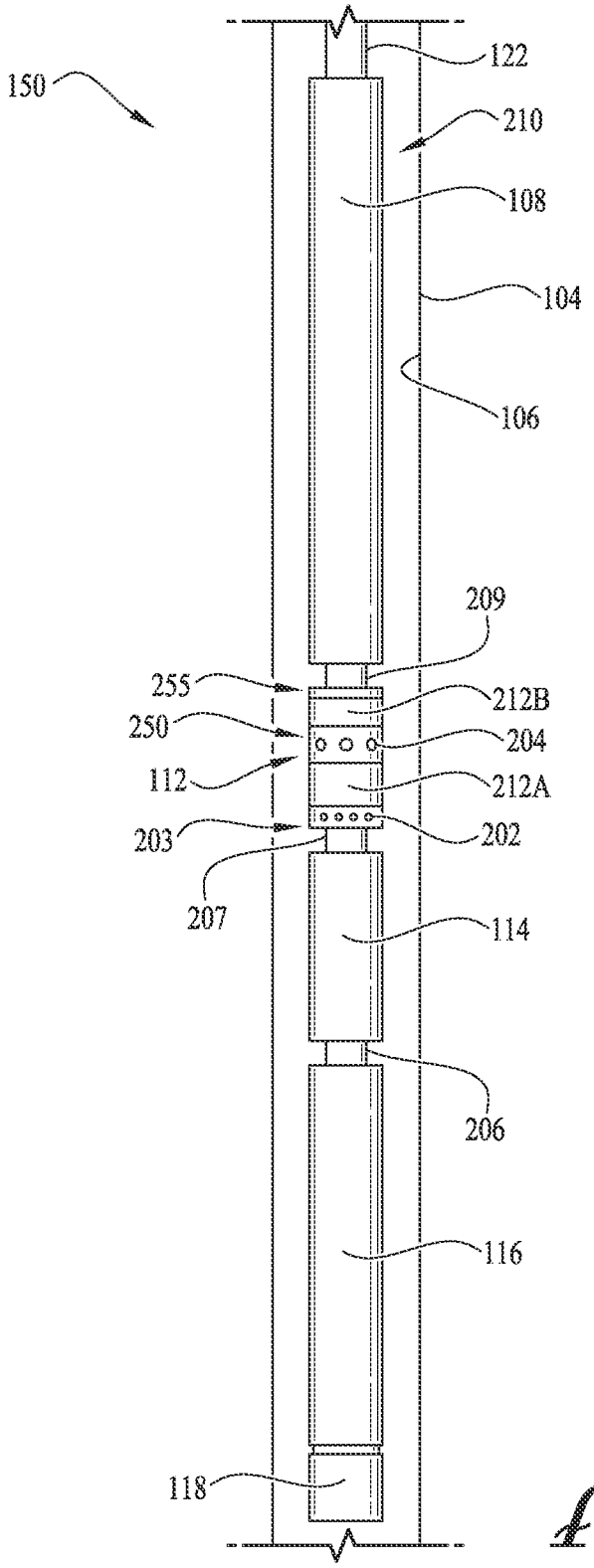
FIG. 2 is an illustration of a portion of an electric submersible pump assembly according to an embodiment of the disclosure.

FIG. 2 is an illustrative ESP assembly 150, according to one or more aspects of the present disclosure. A first drive shaft of the electric motor 116 may mechanically couple to a second drive shaft in the seal 114. The second drive shaft may mechanically couple to a third drive shaft of the integrated gas separator and pump assembly 112. The third drive shaft may mechanically couple to a fourth drive shaft of the centrifugal pump assembly 108. Drive shafts may have external teeth or grooves (e.g., splines) and may be mechanically coupled to a proximate drive shaft by a spline coupling or hub coupling featuring mating interior teeth that engage with the teeth or grooves of the drive shafts.

The first drive shaft may transmit or communicate rotation of the electric motor 116 to the second drive shaft of the seal 114, from the second drive shaft to the third drive shaft of the integrated gas separator and pump assembly 112, and from the third drive shaft to the fourth drive shaft of the centrifugal pump assembly 108. The third drive shaft can provide rotational energy and power to one or more fluid movers, impellers, paddle wheels, centrifuge rotors, or augers of the integrated gas separator and pump assembly 112. The fourth drive shaft can provide rotational energy and power to one or more impellers of the centrifugal pump assembly 108. The electric motor 116 may be mechanically coupled to the seal unit 114 by a first coupling 206. The seal unit 114 may be mechanically coupled to the integrated gas separator and pump assembly 112 by a second coupling 207. The integrated gas separator and pump assembly 112 may be mechanically coupled to the centrifugal pump assembly 108 by a third coupling 209.

In an embodiment, the integrated gas separator and pump assembly 112 comprises a base 203, a cylindrical housing 212, a crossover 250, and a head 255. The base 203 has one or more intake ports 202 which may be disposed or positioned at a distal end of the housing 212. The crossover 250 has one or more discharge ports 204. In one or more embodiments, the one or more intake ports 202 and one or more discharge ports 204 may be disposed or positioned circumferentially about the integrated gas separator and pump assembly 112 at a downhole or a distal end and at a middle part, respectively, of the integrated gas separator and pump assembly 112. The one or more intake ports 202 allow fluid 126 to enter the integrated gas separator and pump assembly 112. The one or more discharge ports 204 allow a gas phase or gas component of the fluid 126 to be discharged into an annulus 210 formed between the ESP assembly 150 and the casing 106 or wellbore 104.

In an embodiment, the housing 212 may comprise a lower housing 212A and an upper housing 212B that are separated by the crossover 250. The housings 212A and 212B are cylindrical housings. The housings 212A and 212B may be made of metal. The lower housing 212A at an upstream end may be threadedly coupled to a downstream end of the base 203. The lower housing 212A at an downstream end may be threadingly coupled to an upstream end of the crossover 250, and the upper housing 212B at an upstream end may be threadingly coupled to a downstream end of the crossover 250. The base 203 may be said to be mechanically coupled at a downstream end to an upstream end of the lower housing 212A. The lower housing 212A may be said to be mechanically coupled at a downstream end to an upstream end of the crossover 250. The crossover 250 may be said to be mechanically coupled at a downstream end to an upstream end of the upper housing 212B.

Figure 3:
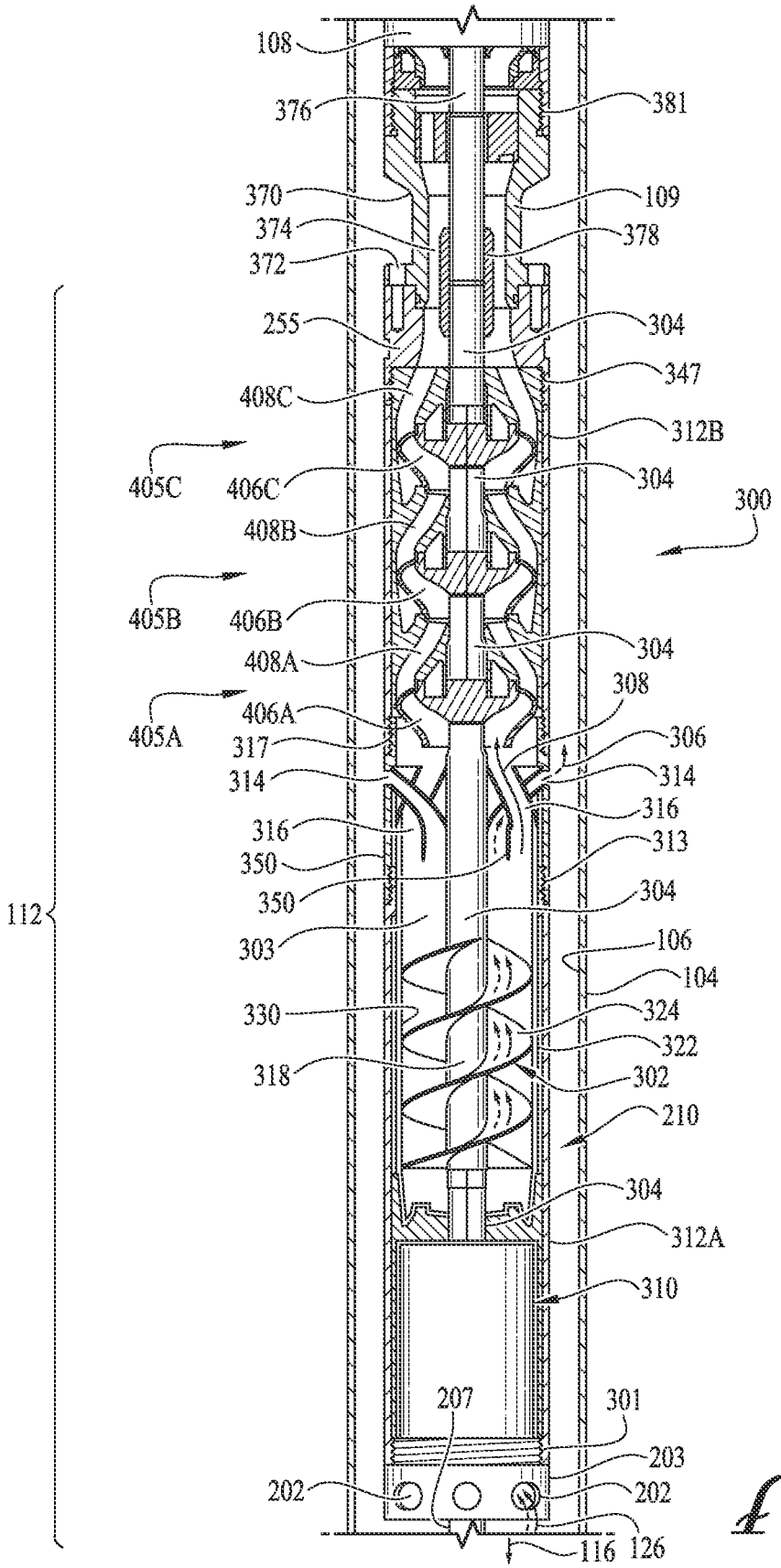
FIG. 3 is an illustration of an integrated gas separator and pump assembly according to an embodiment of the disclosure.

FIG. 3 is a partial cross-sectional view 300 of an illustrative integrated gas separator and pump assembly 112 of the ESP assembly 150, according to one or more aspects of the present disclosure. The integrated gas separator and pump assembly 112 may couple to one or more other components, for example, to a drive shaft 376 of centrifugal pump assembly 108 via a drive shaft 304 of the integrated gas separator and pump assembly 112. The drive shaft 376 may be mechanically coupled to the drive shaft 304 by a coupling sleeve 378 or a coupling hub. For example, each of drive shaft 376 and drive shaft 304 may have external teeth or grooves (e.g., splines), and the coupling sleeve 378 may have internal teeth that mate with the external teeth or grooves of both the drive shafts 376, 304. The rotational power is transferred from the drive shaft 304 to the coupling sleeve 378, and the coupling sleeve 378 transfers the rotational power to the drive shaft 376. In an embodiment, the drive shaft 304 is a solid single-piece drive shaft (e.g., the drive shaft 304 is machined out of a single piece of metal such as steel).

The integrated gas separator and pump assembly 112 may be disposed or positioned within, coupled to or otherwise associated with a cylindrical housing 312 of a downhole tool or system. In one or more embodiments, housing 312 may be substantially similar to the housing 212. In an embodiment, the housing 312 may comprise a first housing 312A (e.g., a lower housing or an upstream housing) and a second housing 312B (e.g., an upper housing or a downstream housing). The base 203 at a downstream end may be threadingly coupled to an upstream end of the first housing 312A by threaded coupling 301. In some contexts, the base 203 may be said to be mechanically coupled to the first housing 312A. The first housing 312A at a downstream end may be threadingly coupled to an upstream end of a crossover 350 by threaded coupling 313, and the second housing 312E at an upstream end may be threadingly coupled to a downstream end of the crossover 350 by threaded coupling 317. The second housing 312E at a downstream end may be threadingly coupled to an upstream end of the head 255 by threaded coupling 347. In an embodiment, the threaded couplings 301, 313, 317, 347 provide sealing joints which substantially prevent flow of fluid across these joints.

The integrated gas separator and pump assembly 112 may comprise a fluid mover 310, a stationary auger 302 and one or more gas phase discharges 314 and one or more liquid phase discharges 316. The fluid mover 310 may be any type of fluid mover, for example, an auger mechanically coupled to the drive shaft 304, an impeller mechanically coupled to the drive shaft, or an impeller and a diffuser system (e.g., where the impeller of the system is mechanically coupled to the drive shaft 304). The one or more intake ports 202 allow intake of fluid 126 from annulus 210 into the fluid mover 310 which communicates or flows the fluid 126 to the stationary auger 302.

In one or more embodiments, the drive shaft 304 may run through shaft 318 or may be the same as shaft 318, The drive shaft 304 may be driven by the electric motor 116. For example, when the electric motor 116 is energized, such as by a command from the controller 120 communicated to the electric motor 116 via electric cable 110, the drive shaft 304 may rotate. The drive shaft 304 extends through the fluid mover 310, through the stationary auger 302, through one or more centrifugal pump stages 405 of the integrated gas separator and pump assembly 112 to couple to the drive shaft 376 to drive the centrifugal pump stages of the centrifugal pump assembly 108 coupled to the integrated gas separator and pump assembly 112. In one or more embodiments, the fluid mover 310 is mechanically coupled to the drive shaft 304 and is hence turned by the electric motor 116. An impeller 406 of each of one or more centrifugal pump stages 405 of the integrated gas separator and pump assembly 112 is mechanically coupled to the drive shaft 304 and is hence turned by the electric motor 116.

In one or more embodiments, the stationary auger 302 is disposed or positioned within a sleeve 330. The fluid mover 310 may couple to the sleeve 330 at a downhole or distal end of the sleeve 330. In one or more embodiments, the stationary auger 302, the sleeve 330 or both are fluidically coupled to the one or more intake ports 202 (e.g., fluidically coupled to the intake ports 202 via the fluid mover 310). For example, the sleeve 330, the stationary auger 302 or both may be coupled to the fluid mover 310 via a support or other device including, but not limited to, the drive shaft 304. Fluid mover 310 communicates or forces fluid 126 received at the one or more intake ports 202 through the sleeve 330, through the stationary auger 302, or through both. In an embodiment, an outside edge of the stationary auger 302 engages sealingly with the sleeve 330, and the flow of fluid 126 through the sleeve 330 is hence confined to the passageway defined by the stationary auger 302. The sleeve 330 may be disposed or positioned within outer housing 312. The sleeve 330 may be secured inside the outer housing 312. In an embodiment, the stationary auger 302 and the sleeve 330 may be built or manufactured as a single component.

In one or more embodiments, the stationary auger 302 comprises one or more helixes or vanes 324. In one or more embodiments, the helixes or vanes 324 may be crescent-shaped. In one or more embodiments, the stationary auger 302 comprises one or more helixes or vanes 324 disposed about a solid core or an open core (for example, a careless auger or an auger (lighting). The stationary auger 302 may cause the fluid 126 to be separated into a liquid phase 308 and gas phase 306 based, at least in part, on rotational flow of the fluid 126. For example, the one or more helixes or vanes 324 may impart rotation to the fluid 126 as the fluid 126 flows through, across or about the one or more helixes or vanes 324. For example, fluid mover 310 forces the fluid 126 at a velocity or flow rate into the sleeve 330 and up or across the one or more helixes or vanes 324 of stationary auger 302.

The rotation of the fluid 126 induced by the stationary auger 302 may be based, at least in part, on the velocity or flow rate of the fluid 126 from the fluid mover 310. For example, the fluid mover 310 may increase the flow rate or velocity of the fluid 126 to increase rotation of the fluid 126 through the stationary auger 302 to create a more efficient and effective separation of the fluid 126 into a plurality of phases, for example, a liquid phase 308 and a gas phase 306. As the fluid 126 flows through the stationary auger 302 it enters a separation chamber 303 and is moving with rotating motion. Centrifugal forces, static friction or both, cause the heavier component of the fluid 126, a liquid phase 308, to circulate along an outer perimeter of the separation chamber while the lighter component of the fluid 126, the gas phase 306, is circulated along an inner perimeter of the separation chamber. In one or more embodiments, fluid 126 may begin to separate into a gas phase 306 and a liquid phase 308 while flowing through stationary auger 302. In one or more embodiments, the liquid phase 308 may comprise residual gas that did not separate into the gas phase 306. However, the embodiments discussed herein reduce this residual gas to protect the pump 108 from gas build-up or gas lock. The separation chamber 303 may be said to comprise an annulus formed between an inside of the housing 312 and an outside of the drive shaft 304.

In one or more embodiments, the separated fluid (for example, liquid phase 308 and gas phase 306) is directed to a crossover 350. For example, the crossover 350 may be disposed or positioned at an uphole or a proximal end of the separation chamber 303 or first housing 312A. In some contexts, the crossover 350 may be referred to as a gas flow path and liquid flow path separator. The crossover 350 may be said to have an inlet that is fluidically coupled to an outlet of the fluid mover 310 (e.g., via fluidically coupled via the stationary auger 302 (or other fluid mover, such as a paddle wheel) and via the separation chamber 303), to have a gas phase discharge port open to the annulus 210 defined between the inside of the wellbore 104 and an outside diameter of the ESP assembly 150, and to have a liquid phase discharge port open to or fluidically coupled to (e.g., via the intermediary of the centrifugal pump stages 405 of the integrated gas separator and pump assembly 112) an inlet of the centrifugal pump assembly 108. For example, the crossover 350 may fluidically couple the separation chamber 303 or otherwise direct one or more components or phases of fluid 126 to the centrifugal pump assembly 108 (e.g., liquid phase fluid) and to the annulus 210 (e.g., gas phase fluid). The crossover 350 may comprise a plurality of channels or define a plurality of channels, for example, a gas phase discharge port 314 (a first pathway) and a liquid phase discharge port 316 (a second pathway). A gas phase 306 of the fluid 126 may be discharged through the gas phase discharge port 314, and a liquid phase 308 of the fluid 126 may be discharged through the liquid phase discharge port 316. In one or more embodiments, gas phase discharge port 314 may correspond to any one or more discharge ports 204 of FIG. 2. In one or more embodiments, any one or more of the gas phase discharge ports 314 and the one or more liquid phase discharge ports 316 may be defined by a channel or pathway having an opening, for example, a teardrop shaped opening, a round opening, an elliptical opening, a triangular opening, a square opening, or another shaped opening.

It is understood that under some operating conditions, the fluid discharged by the gas phase discharge port 314 may be partially gas phase fluid and partially liquid phase fluid. Under some operating conditions, the fluid discharged by the gas phase discharge port 314 may be mostly or entirely liquid phase fluid, for example when the ESP assembly 150 is receiving fluid 126 that has little gas phase content or no gas phase content. In an embodiment, the integrated gas separator and pump assembly 112 is designed to receive much more fluid 126 into the inlets 202 than is delivered via the fluid phase discharge ports 316 to the inlet of the centrifugal pump assembly 108. Said in other words, fluid 126 may flow into the integrated gas separator and pump assembly 112 than fluid 126 flows out of the liquid phase discharge port 316 to the inlet of the centrifugal pump assembly 108. It is understood that under some operating conditions, the fluid discharged by the fluid phase discharge port 316 may be partially gas phase fluid and partially liquid phase fluid.

The head 255 of the integrated gas separator and pump assembly 112 may be mechanically coupled to the centrifugal pump assembly 108 by a coupling flange 109 of the centrifugal pump assembly 108. The coupling flange 109 may comprise a plurality of bolt holes 372 that allow bolts to pass through to engage threads in bolt holes 372 in the head 255 of the integrated gas separator and pump assembly 112. The coupling flange 109 may comprise a narrowing neck 370 to provide access for tools to tighten bolts into the bolt holes 372. The narrowing neck 370 and the coupler 378 create a narrow flow passage 374 between the integrated gas separator and pump assembly 112 and the centrifugal pump assembly 108. The flow passage 374 is an annulus formed between an outside of the coupler 378 and an inside of the head 255 and/or an inside of the flange 109. This kind of narrow flow passage 374 presents a flow restriction in conventional gas separators that may undesirably limit fluid flow rates at high production flow rates.

The present disclosure teaches providing one or more centrifugal pump stages 405 in the integrated gas separator and pump assembly 112 downstream of the crossover 350 and upstream of the inlet of the centrifugal pump assembly 108 to overcome the undesired limiting of fluid flow rates associated with the narrow flow passage 374 in conventional gas separators. In an embodiment, the centrifugal pump stages 405 comprise an impeller 406 and a corresponding diffuser 408. The diffuser 408 may be mechanically coupled to an inside of the housing of the integrated gas separator and pump assembly 112, for example an inside of a second housing 312B. As illustrated in FIG. 3, the integrated gas separator and pump assembly 112 comprises a first centrifugal pump stage 405A having a first impeller 406A and a first diffuser 408A, a second centrifugal pump stage 405B having a second impeller 406B and a second diffuser 408B, and a third centrifugal pump stage 405C having a third impeller 406C and a third diffuser 408C. An inlet of the centrifugal pump stages 405 comprises an annulus formed between the outside of the drive shaft 304 and an inside of the housing (e.g., an inside of the second housing 312B). Alternatively, an inlet of the centrifugal pump stages 405 may be formed by an inlet of the first impeller 406A.

The impellers 406A, 4068, and 406C (collectively referred to as impellers 406) are mechanically coupled to the drive shaft 304 and receive rotational power from the electric motor 116 via the drive shaft 304. For example, the impellers 406 may have keyways that mate with a keyway in the drive shaft 304, and the impellers 406 may be mechanically coupled to the drive shaft 304 by keys inserted into the aligned keyways of the impellers 406 and the drive shaft 304, When the ESP assembly 150 is operating, the impellers 406 rotate while the diffusers 408 remain stationary. The centrifugal pump stages 405 of the integrated gas separator and pump 112 provide kinetic energy and pressure to the liquid phase fluid 308 that helps to force the liquid phase fluid 308 through the narrow flow passage 374, thereby overcoming flow rate restrictions. While FIG. 3 illustrates the integrated gas separator and pump assembly 112 having three centrifugal pump stages located downstream of the crossover 350 (e.g., located downstream of a gas flow path and liquid flow path separator), in another embodiment, the integrated gas separator and pump assembly 112 may comprise a single centrifugal pump stage, two centrifugal pump stages (see FIG. 4 and FIG. 5), four centrifugal pump stages, five centrifugal pump stages, six centrifugal pump stages, or more centrifugal pump stages located downstream of the crossover 350.

The fluid mover 310 may be said to have an inlet that is fluidically coupled to an outlet of the base 203, for example an upstream interior that is open to and fluidically coupled to the base 203 and the inlet ports 202 (e.g. an annulus formed between the drive shaft 304 and an inside of the first housing 312 at the upstream end of the first housing 312). The fluid mover 310 may be said to have an outlet that is fluidically coupled to the stationary auger 302, for example a downstream interior that is open to and fluidically coupled to an upstream end or opening of the stationary auger 302 (or other fluid mover, such as a paddle wheel), with the separation chamber 303, and/or with the sleeve 322 (e.g., an annulus formed between the drive shaft 304 and the interior of the first housing 312). The stationary auger 302, the separation chamber 303, and/or the sleeve 322 may be said to have an inlet that is fluidically coupled to the outlet of the fluid mover 310, for example the openings of the vane 324 or an annulus formed between the drive shaft 304 and the inside of the first housing 312 upstream of the vane 324. The stationary auger 302, the separation chamber 303, and/or the sleeve 322 may be said to have an outlet that is fluidically coupled to an inlet of the crossover 350, for example a downstream interior of the stationary auger 302, of the separation chamber 303, and/or of the sleeve 322 (e.g., an annulus formed between the drive shaft 304 and a downstream end of the first housing 312).

The crossover 350 may be said to have an inlet that is fluidically coupled to the outlet of the stationary auger 302 (or other fluid mover such as a paddle wheel). The inlet of the crossover 350 may be provided as the combination of the upstream end of the gas phase discharge 314 and the upstream end of the liquid phase discharge 316. The inlet of the crossover 350 may be provided by an annulus located upstream of the gas phase discharge 314 and the liquid phase discharge 316 and formed between the drive shaft 304 and an interior surface of a wall of the crossover 350 at an upstream end of the crossover 350. The inlet of the crossover 350 may be provided as a manifold upstream of the gas phase discharge 314 and the liquid phase discharge 316. The crossover 350 may be said to have an outlet that is provided by the liquid phase discharge 316. Alternatively, the crossover 350 may be said to have an outlet that is provided by both the liquid phase discharge 316 and by the gas phase discharge 314. The crossover 350 may be said to have an outlet that is provided by an annulus formed between the drive shaft 304 and an interior surface of a wall of the crossover 350 at a downstream end of the crossover 350 that is fluidically coupled to the centrifugal pump stages 405, for example in the head 255.

The centrifugal pump stages 405 may be said to have an inlet that is fluidically coupled to the liquid phase discharge 316 of the crossover 350, for example an inlet of the first impeller 406A or an annulus defined between the drive shaft 304 and the second housing 312B upstream of the first impeller 406A. The centrifugal pump stages 405 may be said to have an outlet that is fluidically coupled to the flow passage 374, for example an annulus defined between the drive shaft 304 and the second housing 312B downstream of the third diffuser 408C. The inlets may be referred to as fluid inlets in some contexts. The outlets may be referred to as fluid outlets in some contexts. Here the terms inlets and outlets are used to promote concision.

Figure 4:
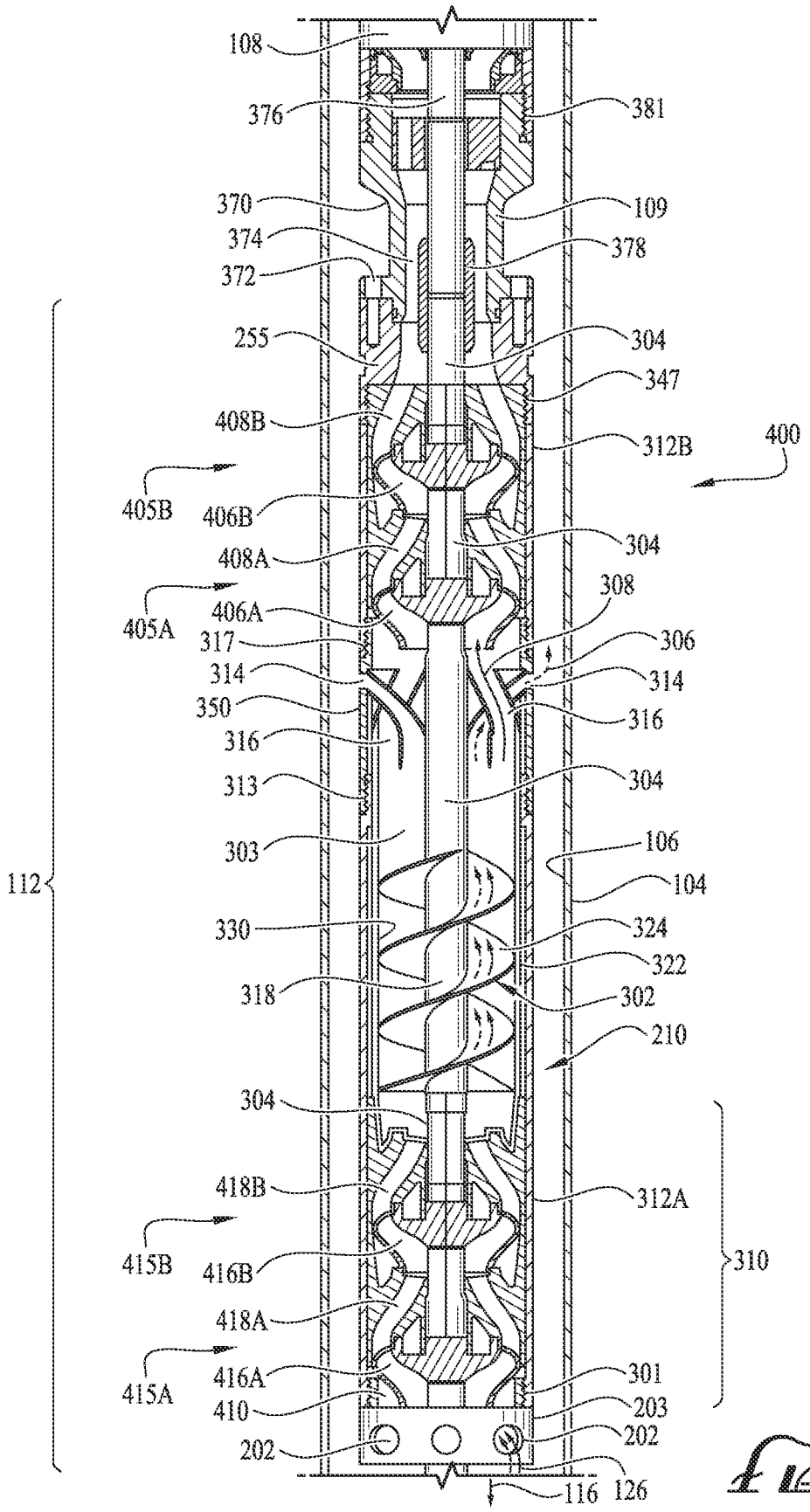
FIG. 4 is an illustration of another integrated gas separator and pump assembly according to an embodiment of the disclosure.

FIG. 4 is a partial cross-sectional view 400 of an illustrative fluid mover 310 of an integrated gas separator and pump assembly 112 of the ESP assembly 150, according to one or more aspects of the present disclosure. The integrated gas separator and pump assembly 112 of FIG. 4 is substantially similar to the assembly 112 of FIG. 3 with reference to the structures downstream of the fluid mover 310, for example with reference to the stationary auger 302, the crossover 350, and the pump stages 405. In FIG. 4, the number of centrifugal pump stages 405 is illustrated as two (versus three stages in FIG. 3) to suggest the number of pump stages can be less than three stages. It is noted that the number of pump stages 405 in an embodiment may be more than three stages.

In one or more embodiments, fluid mover 310 may comprise a bottom portion 410, one or more impellers 416A and 416B (collectively referred to as impellers 416) and one or more diffusers 418A and 418B (collectively referred to as diffusers 418). For example, the bottom portion 410 may comprise a fourth centrifugal pump stage 415A comprising a fourth impeller 416A and a fourth diffuser 418A and a fifth centrifugal pump stage 415B comprising a fifth impeller 416B and a fifth diffuser 418B. The diffusers 418 may be mechanically coupled to the housing 312 of the integrated gas separator and pump assembly 112, for example to the first housing 312A. In one or more embodiments, the fluid mover 310 comprises an impeller 416 without a diffuser 418. Bottom portion 410 of fluid mover 310 may comprise one or ore intake ports 202 for receiving the fluid 126.

The one or more impellers 416 are mechanically coupled to the drive shaft 304 and receive rotational power from the electric motor 116 via the drive shaft 304. For example, the impellers may have keyways that mate with a corresponding keyway in the drive shaft 304 and keys may be inserted into the aligned keyways to mechanically couple the impellers to the drive shaft 304. When the ESP assembly 150 is operating (e.g., the electric motor 166 is turning and the drive shaft 304 is turning), the impellers 416 rotate while the one or more diffusers 418 remain stationary. The one or more impellers 416 and the one or more diffusers 418 emulsify or mix the components of the liquid 126. The one or more impellers 416 and the one or more diffusers 418 cause the fluid 126 to exit the fluid mover 310 at a velocity or flow rate. In one or more embodiments, the drive shaft 304 causes the one or more impellers 416 to spin or rotate to force the fluid 126 through the stationary auger 302 (or other fluid mover such as a paddle wheel) into the separation chamber 303 where the fluid 126 is separated into a gas phase 426 and a liquid phase 428 similar to the discussion of FIG. 3 of gas phase 306 and liquid phase 308. In one or more embodiments, the rotation of the one or more impellers 416 flows the fluid 126 at a velocity or flow rate to induce separation of the fluid 126 into a gas phase 306 and a liquid phase 308 as the fluid 126 flows through or about the stationary auger 302.

Figure 5:
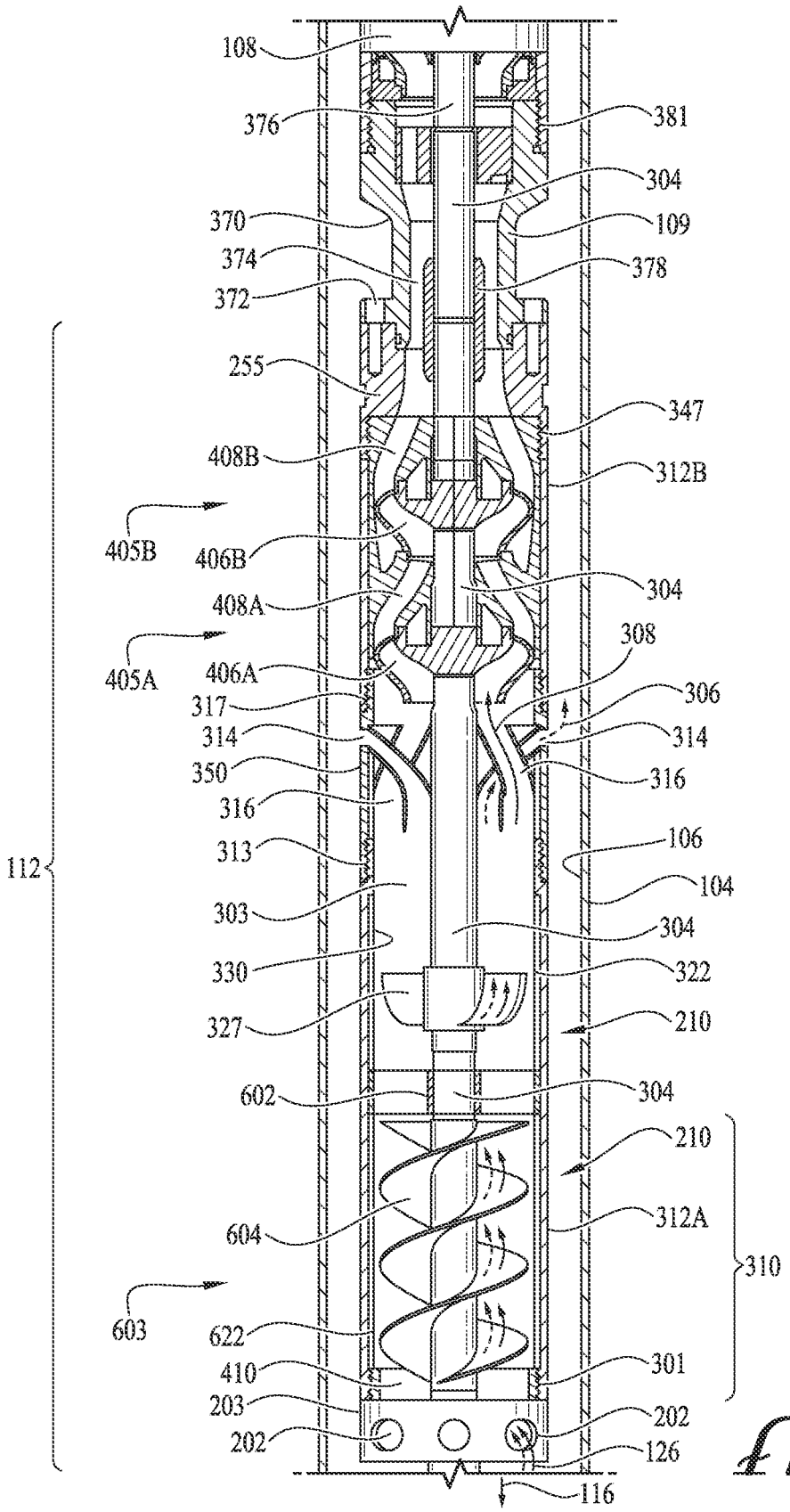
FIG. 5 is an illustration of yet another integrated gas separator and pump assembly according to an embodiment of the disclosure.

Turning now to FIG. 5, an alternative implementation of the fluid mover 310 is described. The integrated gas separator and pump assembly 112 of FIG. 4 is substantially similar to the assembly 112 of FIG. 4 with reference to the structures downstream of the fluid mover 310, for example with reference to the stationary auger 302 (or other fluid mover such as a paddle wheel), the crossover 350 and the pump stages 405. In FIG. 5, rather than centrifugal pump stages 415 as in FIG. 4, the fluid mover 310 is implemented as an auger 603 comprising one or more helical vanes 604. The auger 603 is mechanically coupled to the drive shaft 304 and is turned by the electric motor 116 when the ESP assembly 150 is operating (e.g., the electric motor turns the drive shaft of the electric motor 116, the drive shaft of the electric motor 116 turns the drive shaft of the seal unit 114, the drive shaft of the seal unit 114 turns the drive shaft 304 of the integrated gas separator and pump assembly 112, and the drive shaft 304 turns the auger 603). The auger 603 may have one or more keyways that mate with a keyway on the drive shaft 304, and a key inserted into the keyways when they are aligned may couple the auger 603 to the drive shaft 304. In an embodiment the auger 603 is located within a sleeve 622 that is fixed inside the first housing 312A (e.g., lower housing). In an embodiment, a spider bearing 602 may be provided to stabilize the drive shaft 304. The auger 603 receives fluid 126 at an upstream end (an inlet end) and flows the fluid 126 out a downstream end (an outlet end) to the stationary auger 302 (or other fluid mover such as a paddle wheel). The auger 603 provides increased velocity and/or pressure to the fluid 126 before flowing it to the stationary auger 302 (or other fluid mover such as a paddle wheel).

Figure 6A:
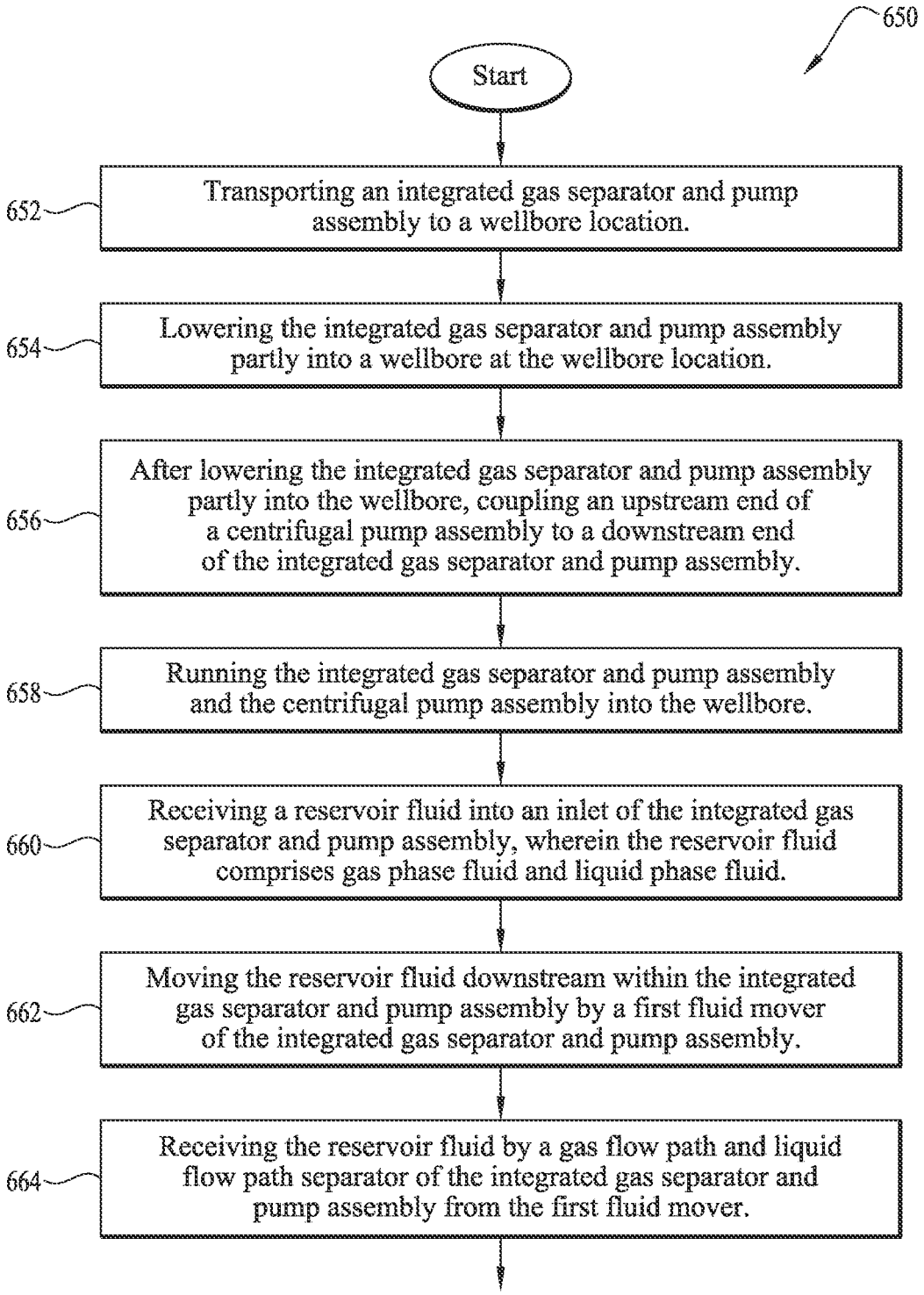
FIG. 6A and FIG. 6B is a flow chart of a method according to an embodiment of the disclosure.
Figure 6B:
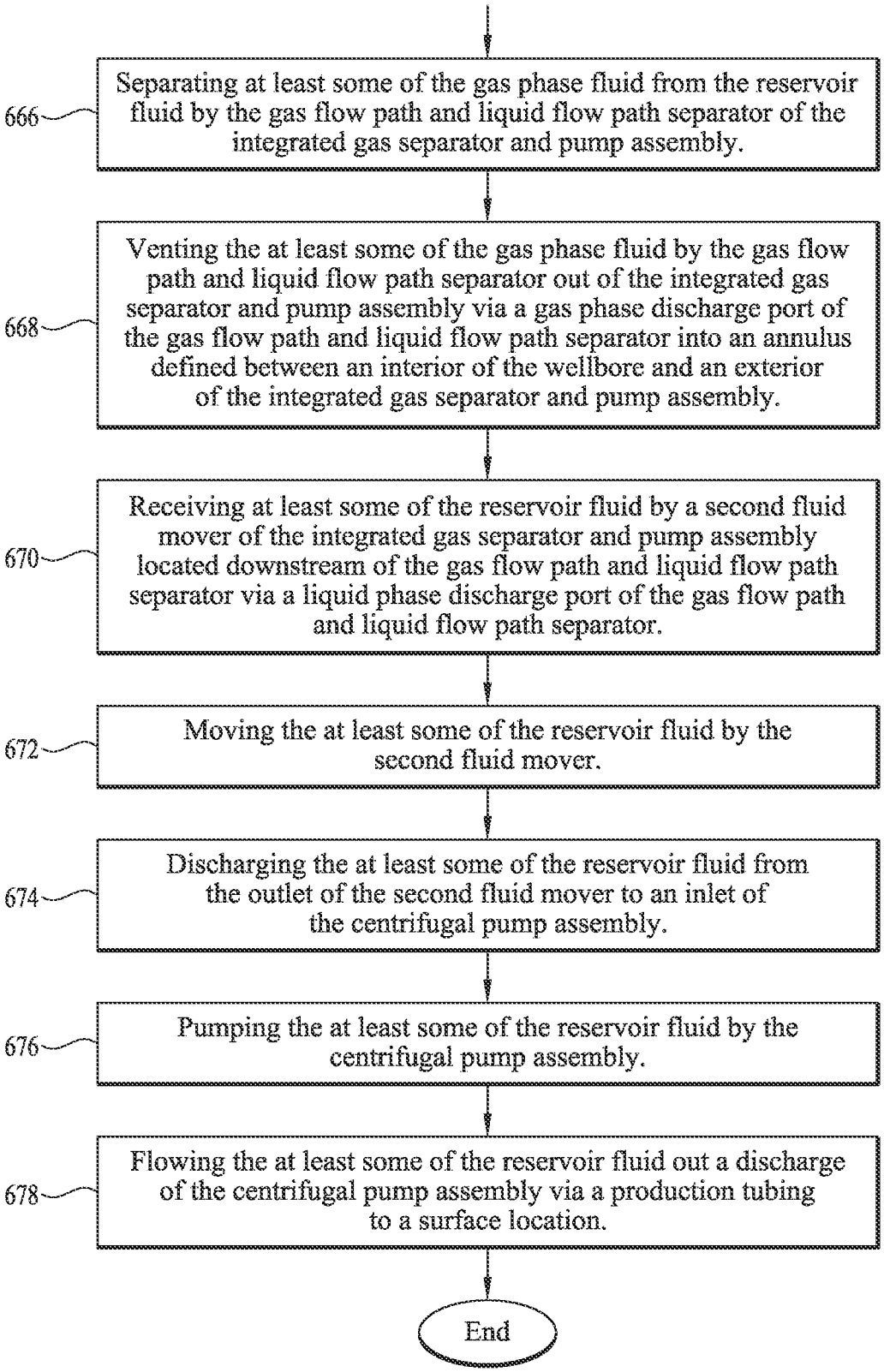

Turning now to FIG. 6A, a method 650 is described. In an embodiment, the method 650 comprises a method of lifting liquid in a wellbore. The liquid may comprise hydrocarbons, for example liquid phase hydrocarbons or a blend of liquid phase and gas phase hydrocarbons. At block 652, the method 650 comprises transporting an integrated gas separator and pump assembly to a wellbore location. The processing of block 652 may comprise transporting the integrated gas separator and pump assembly 112 on a truck to a location of the wellbore 104.

The processing of block 652 may comprise transporting the integrated gas separator and pump assembly 112 on a ship, for example in the case of a wellbore 104 located off-shore. The processing of block 652 may comprise transporting other components of the ESP assembly 150 in a like manner to the location of the wellbore 104.

At block 654, the method 650 comprises lowering the integrated gas separator and pump assembly partly into a wellbore at the wellbore location, for example using a mast structure and/or drilling rig structure to suspend the integrated gas separator and pump assembly 112 over and/or within the wellbore 104. In an embodiment, the processing of block 654 may be preceded by mechanically coupling a downstream end of a drive shaft of a seal unit to an upstream end of a drive shaft of the integrated gas separator and pump assembly. At block 656, the method 650 comprises, after lowering the integrated gas separator and pump assembly partly into the wellbore, coupling an upstream end of a centrifugal pump assembly to a downstream end of the integrated gas separator and pump assembly. In an embodiment, the processing of block 656 may comprise placing an outlet of the integrated gas separator and pump assembly in alignment so as to be fluidically coupled to an inlet of the centrifugal pump assembly. The processing of block 656 may comprise coupling a downstream end of a drive shaft of the integrated gas separator and pump assembly to a upstream end of a drive shaft of the centrifugal pump assembly. For example, the drive shaft 304 of the integrated gas separator and pump assembly 112 may be mechanically coupled to the drive shaft 376 of the centrifugal pump assembly 376 by a coupling sleeve 378. The processing of block 656 may comprise bolting the integrated gas separator and pump assembly 112 and the centrifugal pump assembly 108 together. The processing of block 656 may further comprise coupling the centrifugal pump assembly 108 at its downstream end to the production tubing 122.

At block 658, the method 650 comprises running the integrated gas separator and pump assembly and the centrifugal pump assembly into the wellbore. The processing of block 650 may comprise running the whole ESP assembly 150 attached at its downstream end to the production tubing 122 into the wellbore 104. At block 660, the method 650 comprises receiving a reservoir fluid into an inlet of the integrated gas separator and pump assembly, wherein the fluid comprises gas phase fluid and liquid phase fluid.

At block 662, the method 650 comprises moving the reservoir fluid downstream within the integrated gas separator and pump assembly by a first fluid mover of the integrated gas separator and pump assembly. For example, the fluid 126 is moved downstream by the fluid mover 210 of the integrated gas separator and pump assembly 112. The first fluid mover may impart energy to the fluid 126, for example kinetic energy and/or pressure. The first fluid mover may comprise the centrifugal pump stages 415. The first fluid mover may comprise an auger mechanically coupled to the drive shaft 304.

In an embodiment, the processing of block 662 may comprise flowing the reservoir fluid 126 through the stationary auger 302 and inducing a rotational motion to the reservoir fluid 126 by the stationary auger 302. The stationary auger 302 may be referred to in some contexts as a fluid mover, for example because the stationary auger 302 is moving the fluid 126 into a rotating motion or a swirling motion. In an embodiment, the processing of block 662 may comprise moving the fluid 126 with a paddle wheel mechanically coupled to the drive shaft, whereby the paddle wheel induces a rotational motion in the reservoir fluid. In an embodiment, the processing of block 662 may comprise flowing the reservoir fluid 126 through the stationary auger 302 to a paddle wheel, and moving the reservoir fluid 126 by a paddle wheel downstream of the stationary auger 302. In an embodiment, the processing of block 662 may comprise moving the reservoir fluid into a separation chamber (e.g., the separation chamber 303) located downstream of the first fluid mover, downstream of the stationary auger, and/or downstream of the paddle wheel. Inside the separation chamber, the rotating reservoir fluid may separate into a gas phase fluid (e.g., gas phase 306) that congregates near the drive shaft and into a liquid phase fluid (e.g., liquid phase 308) that congregates near an outer wall of the separation chamber (e.g., near the inside wall of the first housing 312A).

At block 664, the method 650 comprises receiving the reservoir fluid by a gas flow path and liquid flow path separator of the integrated gas separator and pump assembly from the fluid mover. For example, the fluid 126 is received by the crossover 350 of the integrated gas separator and pump assembly 112. For example, the gas phase 306 enters the gas phase discharge 314 of the crossover 350, and the liquid phase 308 enters the liquid phase discharge 316. In an embodiment, the method 650 comprises, before the processing of block 664, receiving the reservoir fluid by a third fluid mover of the integrated gas separator and pump assembly from the first fluid mover, wherein the third fluid mover is located downstream of the first fluid mover; inducing a rotational motion of the reservoir fluid by the third fluid mover; and moving the reservoir fluid downstream within the integrated gas separator and pump assembly by the third fluid mover to a separation chamber of the integrated gas separator and pump assembly, wherein the separation chamber is located downstream of the third fluid mover and upstream of the gas flow path and liquid flow path separator, wherein the gas flow path and liquid flow path separator receives the reservoir fluid from the first fluid mover via the third fluid mover and via the separation chamber.

At block 666, the method 650 comprises separating at least some of the gas phase fluid from the reservoir fluid by the gas flow path and liquid flow path separator of the integrated gas separator and pump assembly. For example, the fluid 126 is partly directed by the crossover 50 of the integrated gas separator and pump assembly 112 into the gas phase discharge ports 314, thereby separating at least some of the gas phase fluid from the reservoir fluid (e.g., fluid 126). At block 668, the method 650 comprises venting the at least some of the gas phase fluid by the gas flow path and liquid flow path separator out of the integrated gas separator and pump assembly via a gas phase discharge port of the gas flow path and liquid flow path separator into an annulus defined between an interior of the wellbore and an exterior of the integrated gas separator and pump assembly. For example, the crossover 150 of the integrated gas separator and pump assembly 112 vents or exhausts at least some of the gas phase fluid via the gas phase discharge 114 to the annulus 210 defined between an inside of the wellbore 104 and an outside of the ESP assembly 150.

At block 670, the method 650 comprises receiving at least some of the reservoir fluid by a second fluid mover of the integrated gas separator and pump assembly located downstream of the gas flow path and liquid flow path separator via a liquid phase discharge port of the gas flow path and liquid flow path separator. For example, at least some of the reservoir fluid (fluid 126) is received via the liquid phase discharge ports 316 of the crossover 350 by the first centrifugal pump stage 405A of the integrated gas separator and pump assembly 112. It is noted that the passage of the reservoir fluid (fluid 126) from the liquid phase discharge ports 316 to the inlet of the first centrifugal pump stage 405A is unimpeded by a narrowing of a flow passage. Said in other words, because there is no bolted coupling between the crossover 350 and the pump (e.g., the centrifugal pump stages 405) of the integrated gas separator and pump assembly 112, there is no narrowed neck as there is at the coupling 109 between the integrated gas separator and pump assembly 112 and the centrifugal pump assembly 108, there is no narrowing of the flow path between the crossover 350 and the pump stages 405 and hence no impeding of the rapid flow of the fluid 126. The flow path between the liquid phase discharge ports 116 of the crossover 350 and the inlet of the pump stages 405 is the annulus defined between the outside diameter of the drive shaft 304 of the integrated gas separator and pump assembly 112 and the inside diameter of the housing 312B of the integrated gas separator and pump assembly 112. Note that this annulus is substantially bigger in cross-sectional area, and hence promotes greater ease of flow of fluid 126, than the flow path between the outlet of the pump stages 405 and the inlet of the centrifugal pump assembly 108 (e.g., the annulus defined between an outside diameter of the coupling sleeve 374 and an inside diameter of the coupling 109 at the bolt holes 372 of the coupling 109). While in an embodiment the second fluid mover may be a centrifugal pump, in other embodiments the second fluid mover may be an auger mechanically coupled to the drive shaft, a centrifuge rotor mechanically coupled to the drive shaft, or a paddle wheel mechanically coupled to the drive shaft.

At block 672, the method 650 comprises moving the at least some of the reservoir fluid by the second fluid mover.

The processing of block 672 may comprise increasing the pressure of the at least some of the reservoir fluid at an outlet of the second fluid mover (e.g., at an outlet of the pump stages 405), The processing of block 672 may comprise increasing the kinetic energy of the at least some of the reservoir fluid at the outlet of the second fluid mover.

At block 674, the method 650 comprises discharging the at least some of the reservoir fluid from the outlet of the second fluid mover to the inlet of the centrifugal pump assembly. In an embodiment, the processing of block 674 comprises forcing the at least some of the reservoir fluid (e.g., fluid 126) through the narrow flow passage 374 defined by the annulus between the outside diameter of the coupling 378 and the inside diameter of the coupling flange 109 at the bolt holes 372. In some contexts, the flow passage 374 may be referred to as an annular flow passage. In an embodiment, "forcing" the fluid 126 through the flow passage 374 may comprise boosting the potential energy of the fluid 126, for example by increasing the pressure of the fluid 126 as it exits the outlet of the second fluid mover (e.g., the second fluid mover increases the pressure of the fluid 126). The "forcing" of the fluid 126 through the narrow flow passage by the pump stages 405 can increase the rate of flow of the fluid 126 out of the integrated gas separator and pump assembly 112 and into the centrifugal pump assembly 108 with reference to the rate of flow that would otherwise occur without the pump stages 405. Additionally, the "forcing" of the fluid 126 may raise the inlet pressure at the input of the centrifugal pump assembly and hence ease its burden in generating head to lift fluid 126 up the production tubing 122 to the surface 102.

At block 676 the method 650 comprises pumping the at least some of the reservoir fluid by the centrifugal pump. At block 678, the method 650 comprises flowing the at least some of the reservoir fluid out a discharge of the centrifugal pump via a production tubing to a surface location. For example, the centrifugal pump assembly 108 flows fluid 126 via production tubing 122 to the surface 102. In an embodiment, the integrated gas separator and pump assembly comprises a drive shaft and the second fluid mover comprises a paddle wheel mechanically coupled to the drive shaft, an impeller mechanically coupled to the drive shaft, an auger mechanically coupled to the drive shaft, or at least one centrifugal pump stage, wherein each centrifugal pump stage comprises an impeller mechanically coupled to the drive shaft and a diffuser. In another embodiment, however, the integrated gas separator and pump assembly may have a different configuration.

Figure 7A:
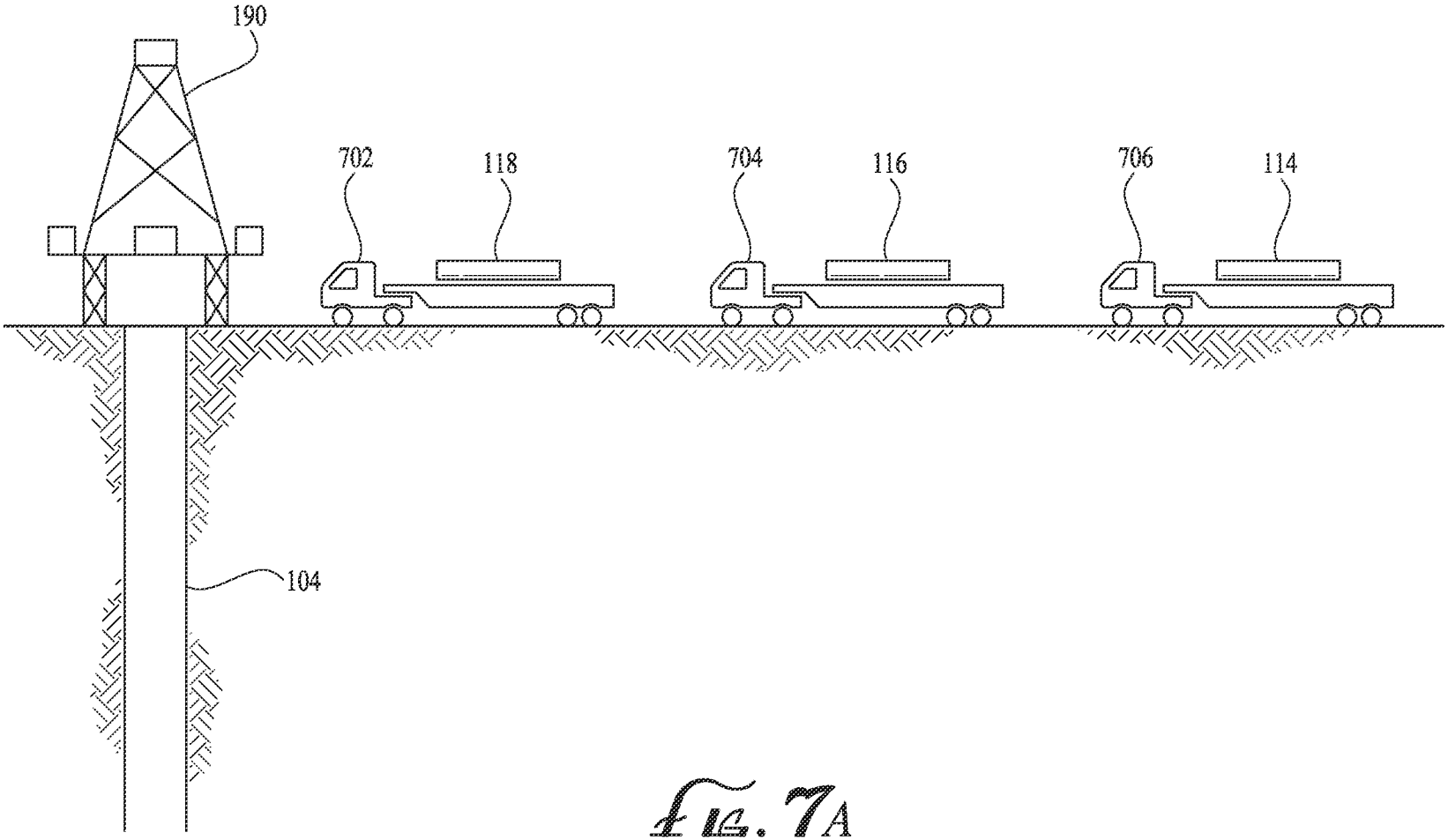
FIG. 7A and FIG. 7B are illustrations of trucks delivering components of an electric submersible pump assembly to a wellbore location according to an embodiment of the disclosure.
Figure 7B:
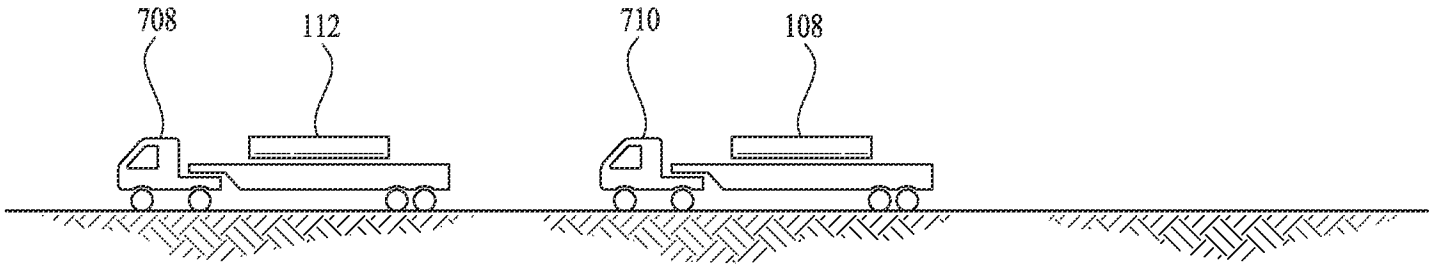

Turning now to FIG. 7A and FIG. 7B, a process of transporting a set of ESP assembly components to the wellbore 104 and staging them prior to assembling these components to form the ESP assembly 150 in the wellbore 104 is described. In an embodiment, the sensor package 118, the electric motor 116, the seal 114, the integrated gas separator and pump assembly 112, and the centrifugal pump assembly 108 may be transported by separate trucks to a location proximate to a mast structure 190 (e.g., drilling rig). For example, the sensor package 118 may be transported by a first truck 702, the electric motor 116 may be transported by a second truck 704, the seal 114 may be transported by a third truck 706, the integrated gas separator and pump assembly 112 may be transported by a fourth truck 708, and the centrifugal pump assembly 108 may be transported by a fifth truck 710. In another example, some of the separate components may be transported by the same truck. It may be desirable that the trucks 702, 704, 706, 708, 710 approach the location and/or mast structure 190 in an order in which the components of the ESP assembly 150 are to be run into the wellbore 104.

Figure 7E:
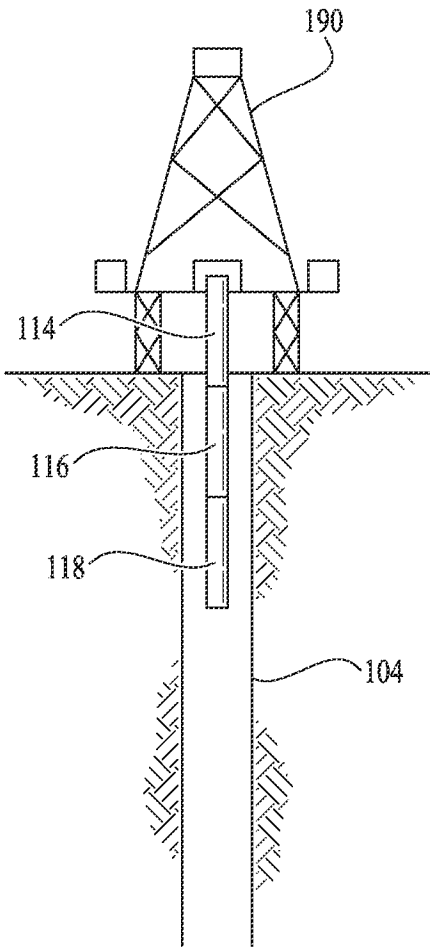
FIG. 7C, FIG. 7D, FIG. 7E, FIG. 7F, and FIG. 7G are illustrations that depict the progressive assembling of the electric submersible pump assembly in the wellbore pursuant to running in and setting a completion string in the wellbore according to an embodiment of the disclosure.
Figure 7D:
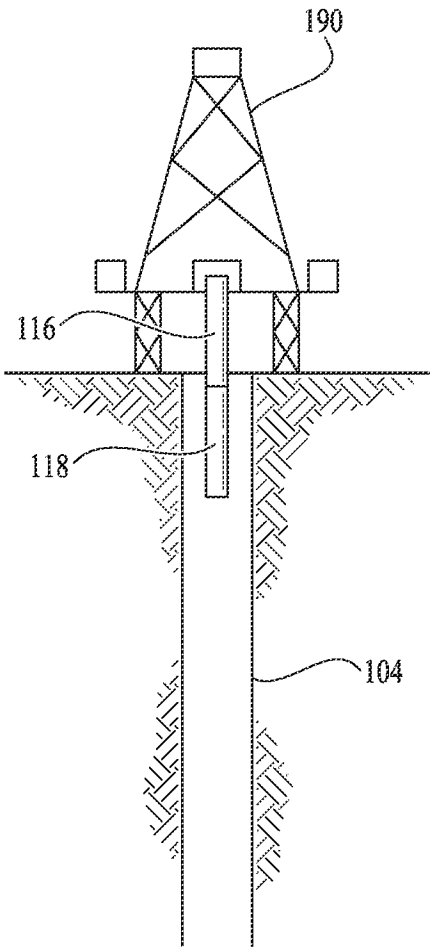
Figure 7C:
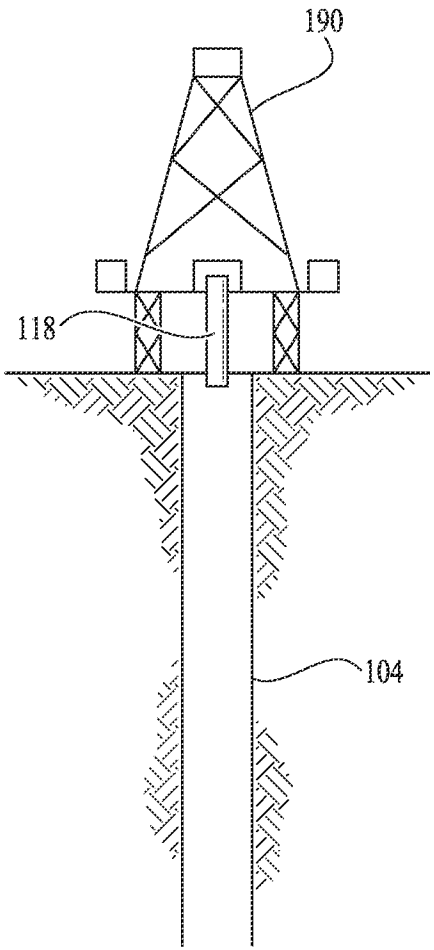

Turning now to FIG. 7C, FIG. 7D, FIG. 7E, FIG. 7F, FIG. 7G, a sequence of assembly of the ESP assembly 150 in the wellbore 104 is illustrated. In FIG. 7C the sensor package 118 is run into the wellbore 104 and hangs from a floor of the mast structure 190 (e.g., an uphole end of the sensor package 118 is retained by slips). At this stage, the electric motor 116 may be lifted by the mast structure 190 (e.g., the blocks and draw works) and lowered to mate a downhole end of the electric motor 116 to an uphole end of the sensor package 118. The sensor package 118 and the electric motor 116 may be bolted together.

In FIG. 7D, the coupled sensor package 118 and electric motor 116 are run into the wellbore 104 and the electric motor 116 hangs from the floor of the mast structure 190 (e.g., an uphole end of the electric motor 116 is retained by slips) into the wellbore 104. At this stage, the seal unit 114 may be lifted by the mast structure 190 and lowered to mate a downhole end of the seal unit 114 with the uphole end of the electric motor 116. The mating may involve coupling an uphole end of a drive shaft of the electric motor 116 with a downhole end of a drive shaft of the seal unit 114. For example, the uphole end of the drive shaft of the electric motor 116 may have external teeth, the downhole end of the drive shaft of the seal unit 114 may have external teeth, and the two drive shafts may be mechanically coupled by a coupling sleeve having internal teeth that mate with the external teeth of the two drive shafts. The electric motor 116 and the seal unit 114 may be bolted together. The seal unit 114 may be provided with sealing oil or other internal fluid.

In FIG. 7E, the coupled sensor package 118, the electric motor 116, and the seal unit 114 are run into the wellbore 104 and the seal unit 114 hangs from the floor of the mast structure 190 (e.g., an uphole end of the seal unit 114 is retained by slips) into the wellbore 104. At this stage, the integrated gas separator and pump assembly 112 may be lifted by the mast structure 190 and lowered to mate a downhole end of the integrated gas separator and pump assembly 112 with the uphole end of the seal unit 114. The mating may involve coupling an uphole end of the drive shaft of the seal unit 114 to a downhole end of a drive shaft (e.g., drive shaft 304) of the integrated gas separator and pump assembly 112. For example, the uphole end of the drive shaft of the seal unit 114 may have external teeth, the downhole end of the drive shaft of the integrated gas separator and pump assembly 112 may have external teeth, and the two drive shafts may be mechanically coupled by a coupling sleeve having internal teeth that mate with the external teeth of the two drive shafts. The seal unit 114 and the integrated gas separator and pump assembly 112 may be bolted together.

Figure 7G:
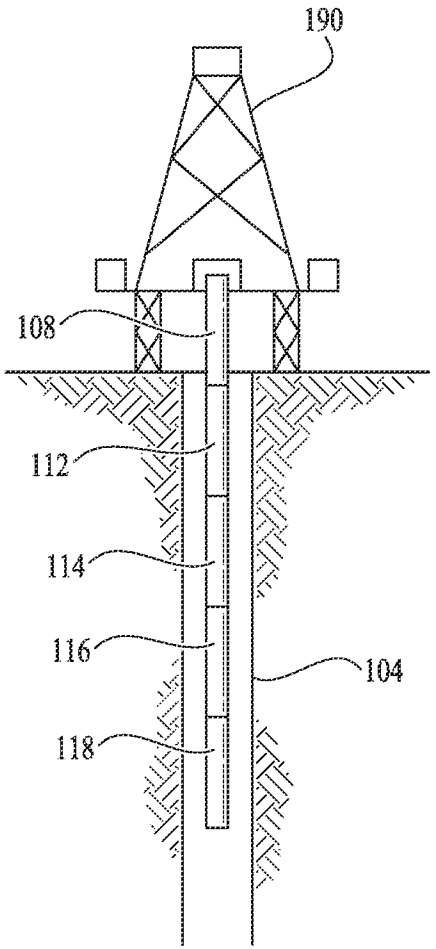
Figure 7F:
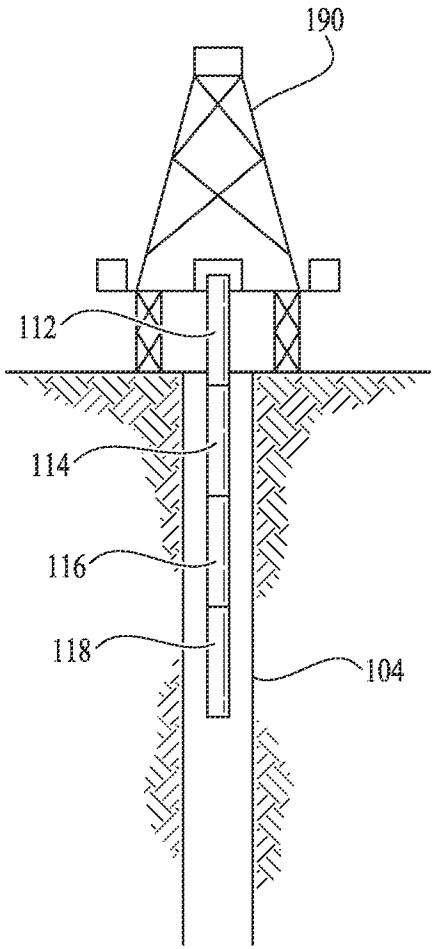

In FIG. 7F, the coupled sensor package 118, the electric motor 116, the seal unit 114, and integrated gas separator and pump assembly 112 are run into the wellbore 104 and the integrated gas separator and pump assembly 112 hangs from the floor of the mast structure 190 (e.g., an uphole end of the integrated gas separator and pump assembly 112 is retained by slips) into the wellbore 104. At this stage, the centrifugal pump assembly 108 may be lifted by the mast structure 190 and lowered to mate a downhole end of the centrifugal pump assembly 108 with the uphole end of the integrated gas separator and pump assembly 112. The mating may involve aligning the liquid discharge ports 316 with an inlet of the centrifugal pump assembly 108. The mating may involve coupling an uphole end of the drive shaft (e.g., drive shaft 304) of the integrated gas separator and pump assembly 112 to a downhole end of a drive shaft (e.g., drive shaft 376) of the centrifugal pump assembly 108. For example, the uphole end of the drive shaft (e.g., drive shaft 304) of the integrated gas separator and pump assembly 112 may have external teeth, the downhole end of the drive shaft (e.g., drive shaft 376) of the centrifugal pump assembly 108 may have external teeth, and the two drive shafts may be mechanically coupled by a coupling sleeve (e.g., coupling sleeve 378) having internal teeth that mate with the external teeth of the two drive shafts. The integrated gas separator and pump assembly 112 and the centrifugal pump assembly 108 may be bolted together. For example, the coupling flange 109 of the centrifugal pump assembly 108 may be mechanically coupled to the integrated gas separator and pump assembly 112 by threading bolts into bolt holes 372. This may complete assembly of the ESP assembly 150.

In FIG. 7G, the coupled sensor package 118, the electric motor 116, the seal unit 114, integrated gas separator and pump assembly 112, and centrifugal pump assembly 108 (e.g., the ESP assembly 150) are run into the wellbore 104 and the centrifugal pump assembly 108 hangs from the floor of the mast structure 190 (e.g., an uphole end of the centrifugal pump assembly 108 is retained by slips) into the wellbore 104. At this stage, the production tubing 122 may be mechanically coupled to the uphole end of the centrifugal pump assembly 108, for example via the coupling 128.

Figure 8:
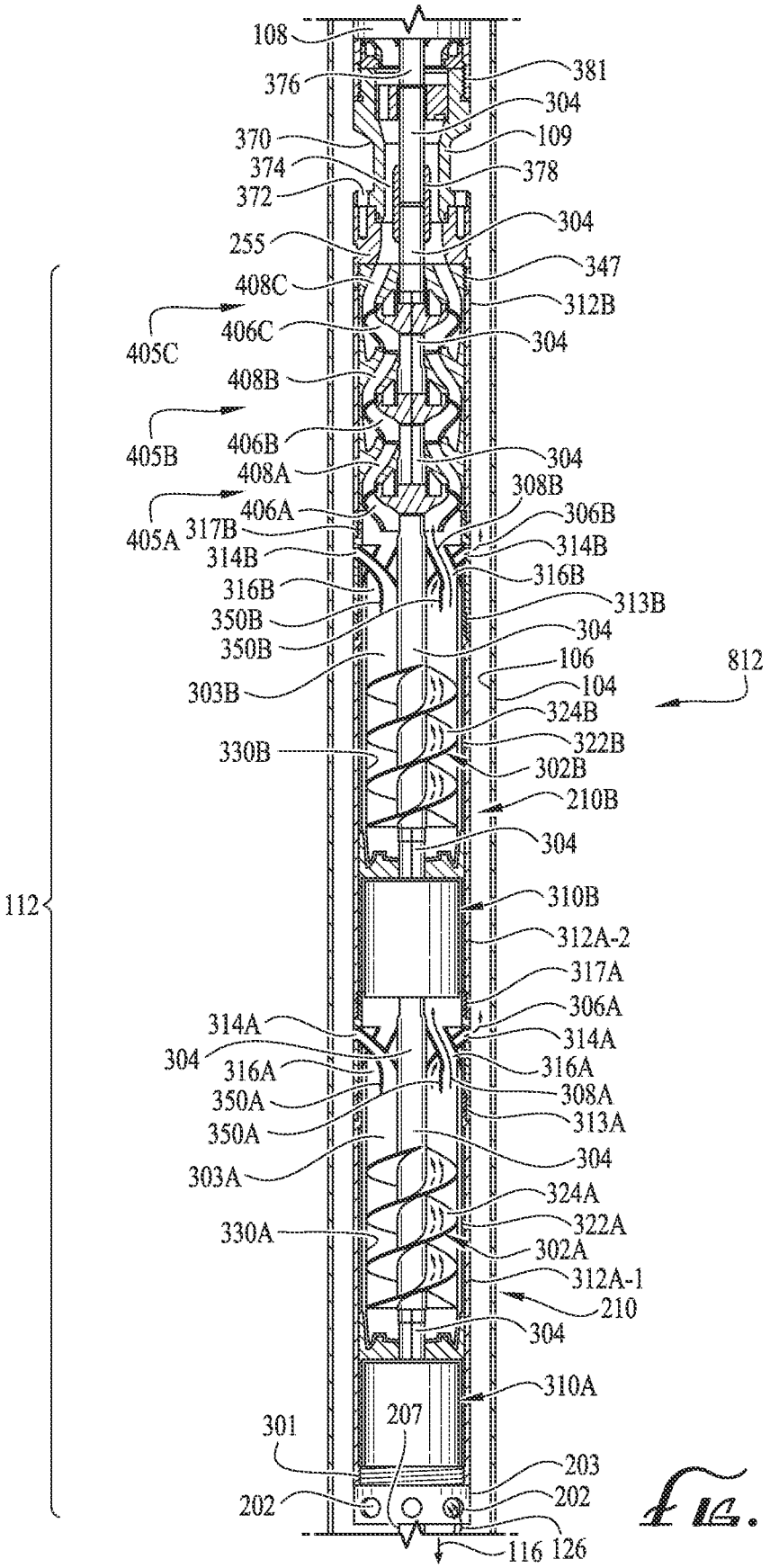
FIG. 8 is an illustration of yet another integrated gas separator and pump assembly according to an embodiment of the disclosure.

Turning now to FIG. 8, an integrated gas separator and pump assembly 812 is described. The integrated gas separator and pump assembly 812 of FIG. 8 may be referred to in some contexts as having tandem gas separators or multiple separators. In the integrated gas separator and pump assembly 812 the combination of the fluid mover 310, the stationary auger 302, and the crossover 350 is repeated to include two gas separators, while the pump stages 405A, 405B, 405C remain as those discussed previously, A first gas separator may comprise a first fluid mover 310A, a first stationary auger 302A, and a first crossover 350A. The first fluid mover 310A and the first stationary auger 302A are retained within housing 312A-1. The housing 312A-1 at a downhole end couples threadingly to an uphole end of the base 203 by threaded coupling 301. The housing 312A-1 at an uphole end couples threadingly to a downhole end of the first crossover 350A by threaded coupling 313A. A second gas separator may comprise a second fluid mover 310B, a second stationary auger 302B, and a second crossover 350B. The second fluid mover 310B and the second stationary auger 302B are retained within housing 312A-2. The housing 312A-2 at a downhole end couples threadingly to an uphole end of the first crossover 350A by threaded coupling 317A. The housing 312A-2 at an uphole end couples threadingly to a downhole end of the second crossover 356E by threaded coupling 313B. The second crossover 350E at an uphole end couples threadingly to the second housing 312E by threaded coupling 317B.

The first stationary auger 302A comprises a first separation chamber 303A, a first sleeve 322A, and a first one or more helixes or vanes 324A. The first crossover 350A comprises a first set of gas phase discharge ports 314A and a first set of liquid phase discharge ports 316A. The second stationary auger 302B comprises a second separation chamber 303B, a second sleeve 322B, and a second one or more helixes or vanes 324 B. The first set of gas phase discharge ports 314A discharge gas phase fluid 306A into the annulus 210, and the first set of fluid phase discharge ports 316A discharge liquid phase fluid 308A into an inlet of the second fluid mover 310B. The second crossover 3503 comprises a second set of gas phase discharge ports 314E and a second set of liquid phase discharge ports 316B. The second set of gas phase discharge ports 314E discharge gas phase fluid 306E into the annulus 210, and the second set of liquid phase discharge ports 316B discharge liquid phase fluid 308B into an inlet of the first centrifugal pump stage 405A.

This tandem gas separator configuration may be useful in a wellbore 104 having a higher concentration of gas phase fluid. Thus, separating the gas phase fluid from the liquid phase fluid twice may result in a suitable concentration of liquid phase fluid being fed to the inlet of the centrifugal pump assembly 108. It is noted that the flow rate of reservoir fluid 126 flowing into the inlet ports 202 of the first fluid mover 310A may be higher than the flow rate of reservoir fluid 126 flowing via the liquid phase discharge ports 316A into the inlet of the second fluid mover 310B, and that the rate of reservoir fluid 126 into the second fluid mover 310B may be higher than the flow rate of reservoir fluid 126 flowing via the liquid phase discharge ports 316B into the inlet of the first centrifugal pump stage 405A. This is because some of the flow of the reservoir fluid 126 is being exhausted out gas phase discharge ports 314A, 314B at each transition, thereby reducing the rate of flow of reservoir fluid 126 to the next component of the integrated gas separator and pump assembly 112. It is also noted that the ratio of gas phase fluid to liquid phase fluid in the reservoir fluid 126 as it proceeds through the two crossovers 350 is changed to make the reservoir fluid 126 that is moved on to have a lower ratio of gas phase fluid to liquid phase fluid (more concentration of liquid phase fluid).

Additional Disclosure

The following are non-limiting, specific embodiments in accordance with the present disclosure:

A first embodiment, which is a downhole gas separator and pump assembly, comprising a drive shaft, a first fluid mover having an inlet and an outlet, a separation chamber concentrically disposed around the drive shaft and located downstream of the first fluid mover, wherein an inside surface of the separation chamber and an outside surface of the drive shaft define an annulus that is fluidically coupled to the fluid outlet of the first fluid mover, a first gas flow path and liquid flow path separator located downstream of the separation chamber and having an inlet fluidically coupled to the annulus, having a gas phase discharge port open to an exterior of the assembly, and having a liquid phase discharge port, and a second fluid mover mechanically coupled to the drive shaft, located downstream of the first gas flow path and liquid flow path separator, having an inlet fluidically coupled to the fluid phase discharge port of the first gas flow path and liquid flow path separator, and having a fluid outlet.

A second embodiment, which is the downhole gas separator and pump assembly of the first embodiment, further comprising a base having at least one inlet, a first housing located downstream of the base and mechanically coupled at an upstream end to a downstream end of the base, located upstream of the first gas flow path and liquid flow path separator and mechanically coupled at a downstream end to an upstream end of the first gas flow path and liquid flow path separator, wherein the first fluid mover is located within the first housing, and wherein the inside surface of the separation chamber is provided by an inside surface of the first housing; and a second housing mechanically coupled to the first gas flow path and liquid flow path separator and located downstream of the first gas flow path and liquid flow path separator, wherein the second fluid mover is located within the second housing.

A third embodiment, which is the downhole gas separator and pump assembly of any of the first and the second embodiments, wherein the first fluid mover is an auger mechanically coupled to the drive shaft, an impeller mechanically coupled to the drive shaft, or a centrifugal pump comprising at least one centrifugal pump stage having an impeller mechanically coupled to the drive shaft and a diffuser.

A fourth embodiment, which is the downhole gas separator and pump assembly of any of the first through the third embodiments, further comprising a third fluid mover having an inlet and an outlet; and a second gas flow path and liquid flow path separator located downstream of the third fluid mover, located upstream of the first fluid mover, having an inlet fluidically coupled to the outlet of the third fluid mover, having a gas phase discharge port open to an exterior of the assembly, and having a liquid phase discharge port, wherein the liquid phase discharge port is fluidically coupled to the inlet of the first fluid mover.

A fifth embodiment, which is the downhole gas separator and pump assembly of any of the first through the fourth embodiments, wherein the second fluid mover comprises a centrifugal pump stage comprising an impeller mechanically coupled to the drive shaft and a diffuser, an auger mechanically coupled to the drive shaft, an impeller mechanically coupled to the drive shaft, or a paddle wheel mechanically coupled to the drive shaft.

A sixth embodiment, which is the downhole gas separator and pump assembly of any of the first through the fifth embodiments, further comprising a fourth fluid mover located downstream of the first fluid mover and located upstream of the separation chamber, wherein the outlet of the first fluid mover is fluidically coupled to an inlet of the fourth fluid mover and an outlet of the fourth fluid mover is fluidically coupled to the annulus of the separation chamber.

A seventh embodiment, which is the downhole gas separator and pump assembly of the sixth embodiment, wherein the fourth fluid mover is a paddle wheel mechanically coupled to the drive shaft or a stationary auger.

An eighth embodiment, which is a method of lifting liquid in a wellbore, comprising transporting an integrated gas separator and pump assembly to a wellbore location, lowering the integrated gas separator and pump assembly partly into a wellbore at the wellbore location, after lowering the integrated gas separator and pump assembly partly into the wellbore, coupling an upstream end of a centrifugal pump assembly to a downstream end of the integrated gas separator and pump assembly, running the integrated gas separator and pump assembly and the centrifugal pump assembly into the wellbore, receiving a reservoir fluid into an inlet of the integrated gas separator and pump assembly, wherein the reservoir fluid comprises gas phase fluid and liquid phase fluid, moving the reservoir fluid downstream within the integrated gas separator and pump assembly by a first fluid mover of the integrated gas separator and pump assembly, receiving the reservoir fluid by a gas flow path and liquid flow path separator of the integrated gas separator and pump assembly from the first fluid mover, separating at least some of the gas phase fluid from the reservoir fluid by the gas flow path and liquid flow path separator of the integrated gas separator and pump assembly, venting the at least some of the gas phase fluid by the gas flow path and liquid flow path separator out of the integrated gas separator and pump assembly via a gas phase discharge port of the gas flow path and liquid flow path separator into an annulus defined between an interior of the wellbore and an exterior of the integrated gas separator and pump assembly, receiving at least some of the reservoir fluid by a second fluid mover of the integrated gas separator and pump assembly located downstream of the gas flow path and liquid flow path separator via a liquid phase discharge port of the gas flow path and liquid flow path separator, moving the at least some of the reservoir fluid by the second fluid mover, discharging the at least some of the reservoir fluid from the outlet of the second fluid mover to an inlet of the centrifugal pump assembly, pumping the at least some of the reservoir fluid by the centrifugal pump assembly; and flowing the at least some of the reservoir fluid out a discharge of the centrifugal pump assembly via a production tubing to a surface location.

A ninth embodiment, which is the method of the eighth embodiment, wherein the integrated gas separator and pump assembly comprises a drive shaft and the second fluid mover comprises a paddle wheel mechanically coupled to the drive shaft, an impeller mechanically coupled to the drive shaft, an auger mechanically coupled to the drive shaft, or at least one centrifugal pump stage, wherein each centrifugal pump stage comprises an impeller mechanically coupled to the drive shaft and a diffuser.

A tenth embodiment, which is the method of any of the eighth and the ninth embodiments, wherein coupling the centrifugal pump to the integrated gas separator and pump assembly comprises mechanically coupling a downstream end of a drive shaft of the integrated gas separator and pump assembly to an upstream end of a drive shaft of the centrifugal pump assembly.

An eleventh embodiment, which is the method of the tenth embodiment, wherein discharging the at least some of the reservoir fluid from the outlet of the second fluid mover to the inlet of the centrifugal pump assembly comprises forcing the at least some of the reservoir fluid through an annular flow passage defined by an inside of a head of the integrated gas separator and pump assembly and by an outside of a coupling sleeve mechanically coupling the drive shaft of the integrated gas separator and pump assembly and the drive shaft of the centrifugal pump assembly.

A twelfth embodiment, which is the method of the eleventh embodiment, further comprising mechanically coupling a downstream end of a drive shaft of a seal unit to an upstream end of a drive shaft of the integrated gas separator and pump assembly.

A thirteenth embodiment, which is the method of any of the eighth through the twelfth embodiments, further comprising receiving the reservoir fluid by a third fluid mover of the integrated gas separator and pump assembly from the first fluid mover, wherein the third fluid mover is located downstream of the first fluid mover, inducing a rotational motion of the reservoir fluid by the third fluid mover, moving the reservoir fluid downstream within the integrated gas separator and pump assembly by the third fluid mover to a separation chamber of the integrated gas separator and pump assembly, wherein the separation chamber is located downstream of the third fluid mover and upstream of the gas flow path and liquid flow path separator, wherein the gas flow path and liquid flow path separator receives the reservoir fluid from the first fluid mover via the third fluid mover and via the separation chamber.

A fourteenth embodiment, which is a downhole gas separator and pump assembly, comprising a drive shaft, a first housing; a base having a plurality of inlet ports, a first fluid mover located downstream of the base, located within the first housing, having an inlet fluidically coupled to the base, and having an outlet, a first separation chamber concentrically disposed around the drive shaft, located within the first housing, and located downstream of the first fluid mover, wherein an inside surface of the first separation chamber and an outside surface of the drive shaft define a first annulus that is fluidically coupled to the outlet of the first fluid mover, a gas flow path and liquid flow path separator mechanically coupled at an upstream end to a downstream end of the first housing, located downstream of the fluid mover, having an inlet fluidically coupled to the first annulus, having a gas phase discharge port open to an exterior of the assembly, and having a liquid phase discharge port; and a second fluid mover mechanically coupled to the drive shaft, located downstream of the gas flow path and liquid flow path separator, and having an inlet fluidically coupled to the fluid phase discharge port of the gas flow path and liquid flow path separator.

A fifteenth embodiment, which is the downhole gas separator and pump assembly of the fourteenth embodiment, wherein the second fluid mover is a paddle wheel, an impeller, or a centrifugal pump, wherein the centrifugal pump comprises at least one centrifugal pump stage, wherein each centrifugal pump stage comprises an impeller mechanically coupled to the drive shaft and a diffuser.

A sixteenth embodiment, which is the downhole gas separator and pump assembly of any of the fourteenth and the fifteenth embodiments, further comprising a second housing having an upstream end mechanically coupled to a downstream end of the base, a third fluid mover mechanically coupled to the drive shaft, located downstream of the base, located within the second housing, having a outlet, and having an inlet fluidically coupled to the base, a second separation chamber concentrically disposed around the drive shaft, located within the second housing, and located downstream of the third fluid mover, wherein an inside surface of the second separation chamber and an outside surface of the drive shaft define a second annulus that is fluidically coupled to the outlet of the third fluid mover; and a second gas flow path and liquid flow path separator located downstream of the second separation chamber, located upstream of the first fluid mover, having an inlet fluidically coupled to the second annulus, having a gas phase discharge port open to an exterior of the assembly, and having a liquid phase discharge port, wherein the liquid phase discharge port is fluidically coupled to the inlet of the first fluid mover and wherein a downstream end of the gas flow path and liquid flow path separator is mechanically coupled to an upstream end of the first housing.

A seventeenth embodiment, which is the downhole gas separator and pump assembly of any of the fourteenth through the sixteenth embodiments, further comprising a fourth fluid mover located downstream of the first fluid mover, located within the first housing, having an inlet fluidically coupled to the outlet of the first fluid mover, and having an outlet fluidically coupled to the first annulus, wherein the first fluid mover is fluidically coupled to the first annulus via the fourth fluid mover.

An eighteenth embodiment, which is the downhole gas separator and pump assembly of the seventeenth embodiment, wherein the fourth fluid mover is a stationary auger or a paddle wheel.

A nineteenth embodiment, which is the downhole gas separator and pump assembly of any of the fourteenth through the eighteenth embodiments, wherein the drive shaft is a sold single-piece drive shaft.

A twentieth embodiment, which is the downhole gas separator and pump assembly of the nineteenth embodiment, further comprising a third housing that is mechanically coupled at an upstream end to a downstream end of the first gas flow path and liquid flow path separator, wherein the second fluid mover is located within the third housing, and wherein the inlet of the second fluid mover comprises an annulus formed between an outside of the drive shaft and an inside of the third housing.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of Ike magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A downhole integrated gas separator and pump assembly, comprising:

a drive shaft, wherein the drive shaft is a single-piece drive shaft;

a first fluid mover having an inlet and an outlet, wherein the first fluid mover is mechanically coupled to the drive shaft;

a separation chamber concentrically disposed around the drive shaft and located downstream of the first fluid mover, wherein an inside surface of the separation chamber and an outside surface of the drive shaft define an annulus that is fluidically coupled to the fluid outlet of the first fluid mover;

a first gas flow path and liquid flow path separator located downstream of the separation chamber and having an inlet fluidically coupled to the annulus, having a gas phase discharge port open to an exterior of the assembly, and having a liquid phase discharge port; and a second fluid mover mechanically coupled to the drive shaft, located downstream of the first gas flow path and liquid flow path separator, having an inlet fluidically coupled to the fluid phase discharge port of the first gas flow path and liquid flow path separator, and having a fluid outlet that is configured to direct fluid to exit the integrated gas separator and pump assembly.

2. The downhole gas separator and pump assembly of claim 1, further comprising a base having at least one inlet;

a first housing located downstream of the base and mechanically coupled at an upstream end to a downstream end of the base, located upstream of the first gas flow path and liquid flow path separator and mechanically coupled at a downstream end to an upstream end of the first gas flow path and liquid flow path separator, wherein the first fluid mover is located within the first housing, and wherein the inside surface of the separation chamber is provided by an inside surface of the first housing; and a second housing mechanically coupled to the first gas flow path and liquid flow path separator and located downstream of the first gas flow path and liquid flow path separator, wherein the second fluid mover is located within the second housing.

3. The downhole integrated gas separator and pump assembly of claim 1, wherein the first fluid mover is an auger mechanically coupled to the drive shaft, an impeller mechanically coupled to the drive shaft, or a centrifugal pump comprising at least one centrifugal pump stage having an impeller mechanically coupled to the drive shaft and a diffuser.

4. The downhole integrated gas separator and pump assembly of claim 1, further comprising:

a third fluid mover having an inlet and an outlet; and a second gas flow path and liquid flow path separator located downstream of the third fluid mover, located upstream of the first fluid mover, having an inlet fluidically coupled to the outlet of the third fluid mover, having a gas phase discharge port open to an exterior of the assembly, and having a liquid phase discharge port, wherein the liquid phase discharge port is fluidically coupled to the inlet of the first fluid mover.

5. The downhole integrated gas separator and pump assembly of claim 1, wherein the second fluid mover comprises a centrifugal pump stage comprising an impeller mechanically coupled to the drive shaft and a diffuser, an auger mechanically coupled to the drive shaft, an impeller mechanically coupled to the drive shaft, or a paddle wheel mechanically coupled to the drive shaft.

6. The downhole integrated gas separator and pump assembly of claim 1, further comprising a fourth fluid mover located downstream of the first fluid mover and located upstream of the separation chamber, wherein the outlet of the first fluid mover is fluidically coupled to an inlet of the fourth fluid mover and an outlet of the fourth fluid mover is fluidically coupled to the annulus of the separation chamber.

7. The downhole integrated gas separator and pump assembly of claim 6, wherein the fourth fluid mover is a paddle wheel mechanically coupled to the drive shaft or a stationary auger.

8. A method of lifting liquid in a wellbore, comprising:

transporting an integrated gas separator and pump assembly to a wellbore location, wherein the integrated gas separator and pump assembly comprises a drive shaft, wherein the drive shaft is a single-piece drive shaft, a first fluid mover having an inlet and an outlet, wherein the first fluid mover is mechanically coupled to the drive shaft, a separation chamber concentrically disposed around the drive shaft and located downstream of the first fluid mover, wherein an inside surface of the separation chamber and an outside surface of the drive shaft define an annulus that is fluidically coupled to the fluid outlet of the first fluid mover, a first gas flow path and liquid flow path separator located downstream of the separation chamber and having an inlet fluidically coupled to the annulus, having a gas phase discharge port open to an exterior of the assembly, and having a liquid phase discharge port, and a second fluid mover mechanically coupled to the drive shaft, located downstream of the first gas flow path and liquid flow path separator, having an inlet fluidically coupled to the fluid phase discharge port of the first gas flow path and liquid flow path separator, and having a fluid outlet that is configured to direct fluid to exit the integrated gas separator and pump assembly;

lowering the integrated gas separator and pump assembly partly into a wellbore at the wellbore location;

after lowering the integrated gas separator and pump assembly partly into the wellbore, coupling an upstream end of a centrifugal pump assembly to a downstream end of the integrated gas separator and pump assembly;

running the integrated gas separator and pump assembly and the centrifugal pump assembly into the wellbore;

receiving a reservoir fluid into the inlet of the first fluid mover of the integrated gas separator and pump assembly, wherein the reservoir fluid comprises gas phase fluid and liquid phase fluid;

moving the reservoir fluid downstream within the integrated gas separator and pump assembly by the first fluid mover of the integrated gas separator and pump assembly;

receiving the reservoir fluid by the separation the gas flow path and liquid flow path separator of the integrated gas separator and pump assembly from the first fluid mover;

separating at least some of the gas phase fluid from the reservoir fluid by the gas flow path and liquid flow path separator of the integrated gas separator and pump assembly;

venting the at least some of the gas phase fluid by the gas flow path and liquid flow path separator out of the integrated gas separator and pump assembly via the gas phase discharge port of the gas flow path and liquid flow path separator into an annulus defined between an interior of the wellbore and an exterior of the integrated gas separator and pump assembly;

receiving at least some of the reservoir fluid by a second fluid mover of the integrated gas separator and pump assembly located downstream of the gas flow path and liquid flow path separator via the liquid phase discharge port of the gas flow path and liquid flow path separator;

moving the at least some of the reservoir fluid by the second fluid mover;

discharging the at least some of the reservoir fluid from the fluid outlet of the second fluid mover to an inlet of the centrifugal pump assembly;

pumping the at least some of the reservoir fluid by the centrifugal pump assembly; and flowing the at least some of the reservoir fluid out a discharge of the centrifugal pump assembly via a production tubing to a surface location.

9. The method of claim 8, wherein the second fluid mover comprises a paddle wheel mechanically coupled to the drive shaft, an impeller mechanically coupled to the drive shaft, an auger mechanically coupled to the drive shaft, or at least one centrifugal pump stage, wherein each centrifugal pump stage comprises an impeller mechanically coupled to the drive shaft and a diffuser.

10. The method of claim 8, wherein coupling the centrifugal pump to the integrated gas separator and pump assembly comprises mechanically coupling a downstream end of the drive shaft of the integrated gas separator and pump assembly to an upstream end of a drive shaft of the centrifugal pump assembly.

11. The method of claim 10, wherein discharging the at least some of the reservoir fluid from the outlet of the second fluid mover to the inlet of the centrifugal pump assembly comprises forcing the at least some of the reservoir fluid through an annular flow passage defined by an inside of a head of the integrated gas separator and pump assembly and by an outside of a coupling sleeve mechanically coupling the drive shaft of the integrated gas separator and pump assembly and the drive shaft of the centrifugal pump assembly.

12. The method of claim 11, further comprising mechanically coupling a downstream end of a drive shaft of a seal unit to an upstream end of the drive shaft of the integrated gas separator and pump assembly.

13. The method of claim 8, further comprising:

receiving the reservoir fluid by a third fluid mover of the integrated gas separator and pump assembly from the first fluid mover, wherein the third fluid mover is located downstream of the first fluid mover;

inducing a rotational motion of the reservoir fluid by the third fluid mover moving the reservoir fluid downstream within the integrated gas separator and pump assembly by the third fluid mover to a separation chamber of the integrated gas separator and pump assembly, wherein the separation chamber is located downstream of the third fluid mover and upstream of the gas flow path and liquid flow path separator, wherein the gas flow path and liquid flow path separator receives the reservoir fluid from the first fluid mover via the third fluid mover and via the separation chamber.

14. A downhole gas separator and pump assembly, comprising:

a drive shaft;

a first housing;

a base having a plurality of inlet ports;

a first fluid mover located downstream of the base, located within the first housing, having an inlet fluidically coupled to the base, and having an outlet;

a second fluid mover located downstream of the first fluid mover, located within the first housing, having an inlet fluidically coupled to the outlet of the first fluid mover, having an outlet, wherein the second fluid mover is a stationary auger or a paddle wheel;

a first separation chamber concentrically disposed around the drive shaft, located within the first housing, and located downstream of the first fluid mover, wherein an inside surface of the first separation chamber and an outside surface of the drive shaft define a first annulus that is fluidically coupled to the outlet of the second fluid mover and wherein the first fluid mover is fluidically coupled to the first annulus via the second fluid mover;

a gas flow path and liquid flow path separator mechanically coupled at an upstream end to a downstream end of the first housing, located downstream of the fluid mover, having an inlet fluidically coupled to the first annulus, having a gas phase discharge port open to an exterior of the assembly, and having a liquid phase discharge port; and a third fluid mover mechanically coupled to the drive shaft, located downstream of the gas flow path and liquid flow path separator, and having an inlet fluidically coupled to the fluid phase discharge port of the gas flow path and liquid flow path separator.

15. The downhole gas separator and pump assembly of claim 14, wherein the third fluid mover is a paddle wheel, an impeller, or a centrifugal pump, wherein the centrifugal pump comprises at least one centrifugal pump stage, wherein each centrifugal pump stage comprises an impeller mechanically coupled to the drive shaft and a diffuser.

16. The downhole gas separator and pump assembly of claim 14, further comprising:

a second housing having an upstream end mechanically coupled to a downstream end of the base;

a fourth fluid mover mechanically coupled to the drive shaft, located downstream of the base, located within the second housing, having an outlet, and having an inlet fluidically coupled to the base;

a second separation chamber concentrically disposed around the drive shaft, located within the second housing, and located downstream of the fourth fluid mover, wherein an inside surface of the second separation chamber and an outside surface of the drive shaft define a second annulus that is fluidically coupled to the outlet of the fourth fluid mover; and a second gas flow path and liquid flow path separator located downstream of the second separation chamber, located upstream of the first fluid mover, having an inlet fluidically coupled to the second annulus, having a gas phase discharge port open to an exterior of the assembly, and having a liquid phase discharge port, wherein the liquid phase discharge port is fluidically coupled to the inlet of the first fluid mover and wherein a downstream end of the gas flow path and liquid flow path separator is mechanically coupled to an upstream end of the first housing.

17. The downhole gas separator and pump assembly of claim 14, wherein the drive shaft is a single-piece drive shaft.

18. The downhole gas separator and pump assembly of claim 17, further comprising a third housing that is mechanically coupled at an upstream end to a downstream end of the first gas flow path and liquid flow path separator, wherein the third fluid mover is located within the third housing, and wherein the inlet of the third fluid mover comprises an annulus formed between an outside of the drive shaft and an inside of the third housing.

19. The downhole gas separator and pump assembly of claim 14, wherein the gas phase discharge port of the gas flow path and liquid flow path separator has teardrop shaped openings.

20. The downhole gas separator and pump assembly of claim 14, wherein the second fluid mover is a stationary auger, the stationary auger is retained within a sleeve located inside of the first housing, and an outside edge of the stationary auger engages sealingly with the sleeve.

* * * * *